US011248286B2

(12) United States Patent
Ferrasse et al.

(10) Patent No.: US 11,248,286 B2
(45) Date of Patent: *Feb. 15, 2022

(54) ECAE MATERIALS FOR HIGH STRENGTH ALUMINUM ALLOYS

(71) Applicant: Honeywell International Inc., Morris Plains, NJ (US)

(72) Inventors: Stephane Ferrasse, Spokane, WA (US); Susan D. Strothers, Mead, WA (US); Patrick K. Underwood, Spokane Valley, WA (US); Marc D. Ruggiero, Liberty Lake, WA (US); Wayne D. Meyer, Cheney, WA (US); Lucia M. Feng, Fremont, CA (US); Frank C. Alford, Spokane Valley, WA (US)

(73) Assignee: Honeywell International Inc., Charlotte, NC (US)

( * ) Notice: Subject to any disclaimer, the term of this patent is extended or adjusted under 35 U.S.C. 154(b) by 3 days.

This patent is subject to a terminal disclaimer.

(21) Appl. No.: 16/820,261

(22) Filed: Mar. 16, 2020

(65) Prior Publication Data

US 2020/0270730 A1 Aug. 27, 2020

Related U.S. Application Data

(62) Division of application No. 15/824,149, filed on Nov. 28, 2017, now abandoned.

(Continued)

(51) Int. Cl.
*C22F 1/04* (2006.01)
*C22F 1/047* (2006.01)

(Continued)

(52) U.S. Cl.
CPC ..... *C22F 1/053* (2013.01); *C22C 21/02* (2013.01); *C22C 21/06* (2013.01); *C22C 21/10* (2013.01);

(Continued)

(58) Field of Classification Search
None
See application file for complete search history.

(56) References Cited

U.S. PATENT DOCUMENTS 4,770,848 A 9/1988 Ghosh et al.
5,513,512 A 5/1996 Segal (Continued)

FOREIGN PATENT DOCUMENTS

CN 1459512 A 12/2003
CN 1918311 A 2/2007

(Continued)

OTHER PUBLICATIONS

Ferrasse, S. et al., "Development of a submicrometer-grained microstructure in aluminum 6061 using equal channel angular extrusion", Journal of Materials Research, vol. 12, No. 5, pp. 1253-1261, May 1997.*

(Continued)

*Primary Examiner* — George Wyszomierski
(74) *Attorney, Agent, or Firm* — Faegre Drinker Biddle & Reath LLP

(57) ABSTRACT

A method of forming a high strength aluminum alloy. The method comprises subjecting an aluminum material containing at least one of magnesium, manganese, silicon, copper, and zinc at a concentration of at least 0.1% by weight to an equal channel angular extrusion (ECAE) process. The method produces a high strength aluminum alloy having an average grain size from about 0.2 μm to about 0.8 μm and a yield strength from about 300 MPa to about 650 MPa.

9 Claims, 21 Drawing Sheets

Related U.S. Application Data

(60) Provisional application No. 62/503,111, filed on May 8, 2017, provisional application No. 62/429,201, filed on Dec. 2, 2016.

(51) Int. Cl.

| | |
|---|---|
| ***C22F 1/053*** | (2006.01) |
| ***C22F 1/057*** | (2006.01) |
| ***C22F 1/00*** | (2006.01) |
| ***C22C 21/02*** | (2006.01) |
| ***C22C 21/06*** | (2006.01) |
| ***C22C 21/10*** | (2006.01) |
| ***C22F 1/043*** | (2006.01) |
| *B21C 23/00* | (2006.01) |

(52) U.S. Cl.

CPC ..... *C22F 1/002* (2013.01); *C22F 1/043* (2013.01); *C22F 1/047* (2013.01); *C22F 1/057* (2013.01); *B21C 23/001* (2013.01); *B21C 23/002* (2013.01)

(56) References Cited

U.S. PATENT DOCUMENTS

| | | | | |
|---|---|---|---|---|
| 5,620,537 | A | 4/1997 | Bampton | |
| 5,826,456 | A | 10/1998 | Kawazoe et al. | |
| 7,017,382 | B2 | 3/2006 | Segal et al. | |
| 7,296,453 | B1 | 11/2007 | Oruganti et al. | |
| 7,971,464 | B2 | 7/2011 | Hachino et al. | |
| 8,028,558 | B2 | 10/2011 | Segal | |
| 8,137,755 | B2 | 3/2012 | Keener et al. | |
| 8,535,505 | B2 | 9/2013 | Yi et al. | |
| 9,265,169 | B2 | 2/2016 | Zhou et al. | |
| 2002/0017344 | A1 | 2/2002 | Gupta et al. | |
| 2006/0237134 | A1 | 10/2006 | Keener et al. | |
| 2007/0084527 | A1* | 4/2007 | Ferrasse | C22F 1/00 148/550 |
| 2007/0169861 | A1 | 7/2007 | Bischofberger | |
| 2008/0196801 | A1 | 8/2008 | Zhao et al. | |
| 2009/0020192 | A1 | 1/2009 | Segal et al. | |
| 2012/0085470 | A1 | 4/2012 | Segal | |
| 2013/0216852 | A1 | 8/2013 | Hsu et al. | |
| 2014/0190739 | A1 | 7/2014 | Zhou et al. | |
| 2014/0248177 | A1 | 9/2014 | Kamat et al. | |
| 2015/0090373 | A1 | 4/2015 | Gable et al. | |
| 2015/0354045 | A1 | 12/2015 | Gable et al. | |
| 2016/0002805 | A1 | 1/2016 | Browning et al. | |
| 2016/0115575 | A1 | 4/2016 | Bull et al. | |
| 2016/0221318 | A1 | 8/2016 | Ramsden | |
| 2016/0237530 | A1 | 8/2016 | Roy et al. | |
| 2016/0355917 | A1 | 12/2016 | Kawamura et al. | |
| 2017/0023706 | A1 | 1/2017 | Yang et al. | |
| 2017/0101705 | A1 | 4/2017 | Mohanty et al. | |
| 2018/0155811 | A1 | 6/2018 | Ferrasse et al. | |
| 2018/0155812 | A1 | 6/2018 | Ferrasse et al. | |
| 2021/0054490 | A1* | 2/2021 | Ferrasse | C22F 1/043 |

FOREIGN PATENT DOCUMENTS

| | | | |
|---|---|---|---|
| CN | 101690957 | B | 4/2010 |
| CN | 102925827 | A | 2/2013 |
| CN | 103060730 | A | 4/2013 |
| CN | 103909690 | A | 7/2014 |
| CN | 105331858 | A | 2/2016 |
| CN | 205556754 | U | 9/2016 |
| DE | 102008033027 | A1 | 3/2010 |
| EP | 2822717 | A1 | 1/2015 |
| GB | 751125 | A | 6/1956 |
| JP | H09137244 | A | 5/1997 |
| JP | H10258334 | A | 9/1998 |
| JP | 4753240 | B2 | 4/2007 |
| JP | 4920455 | B2 | 9/2008 |
| JP | 5202038 | B2 | 9/2009 |
| KR | 623662 | B1 | 7/2005 |
| KR | 1020050073316 | A | 7/2005 |
| KR | 10-2005-0105825 | A | 11/2005 |
| KR | 2005105825 | A | 11/2005 |
| KR | 778763 | B1 | 11/2007 |
| KR | 2009118404 | A | 11/2009 |
| KR | 20090115471 | A | 11/2009 |
| KR | 20090118404 | A | 11/2009 |
| KR | 1020140041285 | A | 4/2014 |
| RU | 2235799 | C1 | 12/2004 |
| RU | 2396368 | C2 | 1/2010 |
| RU | 2468114 | C1 | 11/2012 |
| RU | 2571993 | C1 | 12/2015 |
| TW | 200540956 | A | 12/2005 |
| WO | 01/44536 | A2 | 6/2001 |
| WO | 2005094280 | A2 | 10/2005 |
| WO | 2010087074 | A1 | 8/2010 |
| WO | 2014010678 | A1 | 1/2014 |
| WO | 2016092135 | A1 | 6/2016 |
| WO | 2017/014990 | A1 | 1/2017 |
| WO | 2017106665 | A1 | 6/2017 |
| WO | 2017108986 | A1 | 6/2017 |
| WO | 2018080710 | A1 | 5/2018 |
| WO | 2018102328 | A1 | 6/2018 |

OTHER PUBLICATIONS

Zhao, Y.H. et al., "Microstructures and mechanical properties of ultrafine grained 7075 alloy processed by ECAP andtheir evolutions during annealing", Acta Materialia, vol. 52, pp. 4589-4599, Available online Jul. 2, 2004.*

International Preliminary Report on Patentability received for PCT Patent Application No. PCT/US2017/063550, dated Jun. 13, 2019, 9 pages.

International Preliminary Report on Patentability received for PCT Patent Application No. PCT/US2017/063562, dated Jun. 13, 2019, 8 pages.

International Search Report and Written Opinion received for PCT Patent Application No. PCT/US2019/056707, dated Feb. 7, 2020, 12 pages.

Ma, K. et al., "Mechanical behavior and strengthening mechanisms in ultrafine grain precipitation-strengthened aluminum alloy", Acta Materialia, vol. 62, pp. 141-155, available online Oct. 24, 2013.

"A Critical Evaluation of the Processing and Properties of Ultrafine-Grained Materials Produced by Intense Plastic Straining." National Science Foundation, Award Abstract #9625969, Investigator Terrence Langdon, Last amendment date is Jan. 8, 1998, 3 pages.

"IK500 High-Strength Die Casting Aluminum Alloy," Brochure, Interplex Quantum Co., Ltd., 2 pages, Available at least as early as Aug. 1, 2016.

Birol, Y. (2004). The effect of homogenization practice on the microstructure of AA6063 billets. Journal of Materials Processing Technology, 148:250-258.

Duan, Zhi Chao; et al. "Developing Processing Routes for the Equal-Channel Angular Pressing of Age-Hardenable Aluminum Alloys." Metallurgical and Materials Transactions A, vol. 41A:802-809, Apr. 2010.

Gao, Nong; et al. "Evolution of Microstructure and Precipitation in Heat-Treatable Aluminum Alloys During ECA Pressing and Subsequent Heat Treatment." Materials Science Forum, vols. 503-504, pp. 275-280, Jan. 15, 2006.

International Search Report and Written Opinion issued in PCT/US2017/063550, dated Feb. 8, 2018, 12 pages.

International Search Report and Written Opinion issued in PCT/US2017/063562, dated Mar. 14, 2018, 11 pages.

Kanetake, N.; et al. "Upgrading in Mechanical Properties of High Performance Aluminum Alloys by Compressive Torsion Process." International Conference on Manufacture of Lightweight Components—ManuLight2014, Procedia CIRP, 18:57-61, 2014.

Mabuchi, Mamoru; et al. "Microstructure and Mechanical Properties of 5056 A1 Alloy Procesed by Equal Channel Angular Extrusion", NanoStructured Materials, vol. 8, No. 8, pp. 1105-1111, Dec. 1997.

(56) References Cited

OTHER PUBLICATIONS

Mishra, Rajiv S. "Processing Commercial Aluminum Alloys for High Strain Rate Superplasticity," JOM, Superplasticity Overview, Mar. 2001, pp. 23-26.
Murashkin, M. Yu.; et al. "Strength of Commerical Aluminum Alloys After Equal Channel Angular Pressing and Post-ECAP Processing." Solid State Phenomena, 114:91-96, 2006.
Ruppert, M; et al. "Mechanical Properties of Ultrafine-Grained AlZnMg(Cu)-Alloys AA7020 and AA7075 Processed by Accumulative Roll Bonding." J. Mater Sci., 50:4422-4429, 2015.
Segal, Vladimir M. "Fabrication of High-Strength Lightweight Metals for Armor and Structural Applications." Engineered Performance Materials Company, LLC, US Army Research Laboratory, Phase I Final Report, Award Period of Jan. 27, 2011 to Mar. 8, 2012, 5 pages.
Shaban, M.; et al. "Plastic Deformation of 7075 Aluminum Alloy Using Integrated Extrusion-Equal Channel Angular Pressing." Journal of Advanced Materials and Processing, 4(1):30-37, 2016.
Showa Denko K.K., "Showa Denko Develops High-Strength Version of ST60 Aluminum Plate," Published Apr. 25, 2016 [online], [retrieved on May 21, 2018]. Retrieved from the Internet <http://www.sdk.co.jp/english/news/2016/12589.html>.
Sun, Yiwei et al. (2014). Effect of Mg2Si Phase on Extrusion of AA6005 Aluminum Alloy. Light Metals; The Minerals, Metals & Materials Society, pp. 429-433.

* cited by examiner

ECAE MATERIALS FOR HIGH STRENGTH ALUMINUM ALLOYS

CROSS-REFERENCE TO RELATED APPLICATION

This application is a divisional application of U.S. application Ser. No. 15/824,149, filed Nov. 28, 2017, which claims priority to Provisional Application No. 62/429,201, filed Dec. 2, 2016 and also claims priority to Provisional Application No. 62/503,111, filed May 8, 2017, all of which are herein incorporated by reference in their entireties.

TECHNICAL FIELD

The present disclosure relates to high-strength aluminum alloys which may be used, for example, in devices requiring high yield strength. More particularly, the present disclosure relates to high-strength aluminum alloys that have high yield strength and which may be used to form cases or enclosures for electronic devices. Methods of forming high-strength aluminum alloys and high-strength aluminum cases or enclosures for portable electronic devices are also described.

BACKGROUND

There is a general trend toward decreasing the size of certain portable electronic devices, such as laptop computers, cellular phones, and portable music devices. There is a corresponding desire to decrease the size of the outer case or enclosure that holds the device. As an example, certain cellular phone manufacturers have decreased the thickness of their phone cases, for example, from about 8 mm to about 6 mm. Decreasing the size, such as the thickness, of the device case may expose the device to an increased risk of structural damage, both during normal use and during storage between uses, specifically due to device case deflection. Users handle portable electronic devices in ways that put mechanical stresses on the device during normal use and during storage between uses. For example, a user putting a cellular phone in a back pocket of his pants and sitting down puts mechanical stress on the phone which may cause the device to crack or bend. There is thus a need to increase the strength of the materials used to form device cases in order to minimize elastic or plastic deflection, dents, and any other types of damage.

SUMMARY

Disclosed herein is a method of forming a high strength aluminum alloy. The method comprises subjecting an aluminum material containing at least one of magnesium, manganese, silicon, copper, and zinc at a concentration of at least 0.1% by weight to a temperature from about 400° C. to about 550° C. to form a heated aluminum material. The method further includes quenching the solutionized aluminum material to below about room temperature to form a cooled aluminum material. The method also includes subjecting the aluminum alloy to an equal channel angular extrusion (ECAE) process while maintaining the cooled aluminum material at a temperature between about 20° C. and 200° C. to form a high strength aluminum alloy. The high strength aluminum alloy has an average grain size from about 0.2 μm to about 0.8 μm in diameter and a yield strength greater than about 300 MPa.

Also disclosed herein is a high strength aluminum alloy material comprising an aluminum material containing at least one of magnesium, manganese, silicon, copper, and zinc at a concentration of at least 0.1% by weight. The high strength aluminum alloy material has an average grain size from about 0.2 μm to about 0.8 μm in diameter and a yield strength greater than about 300 MPa.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Figure 1:
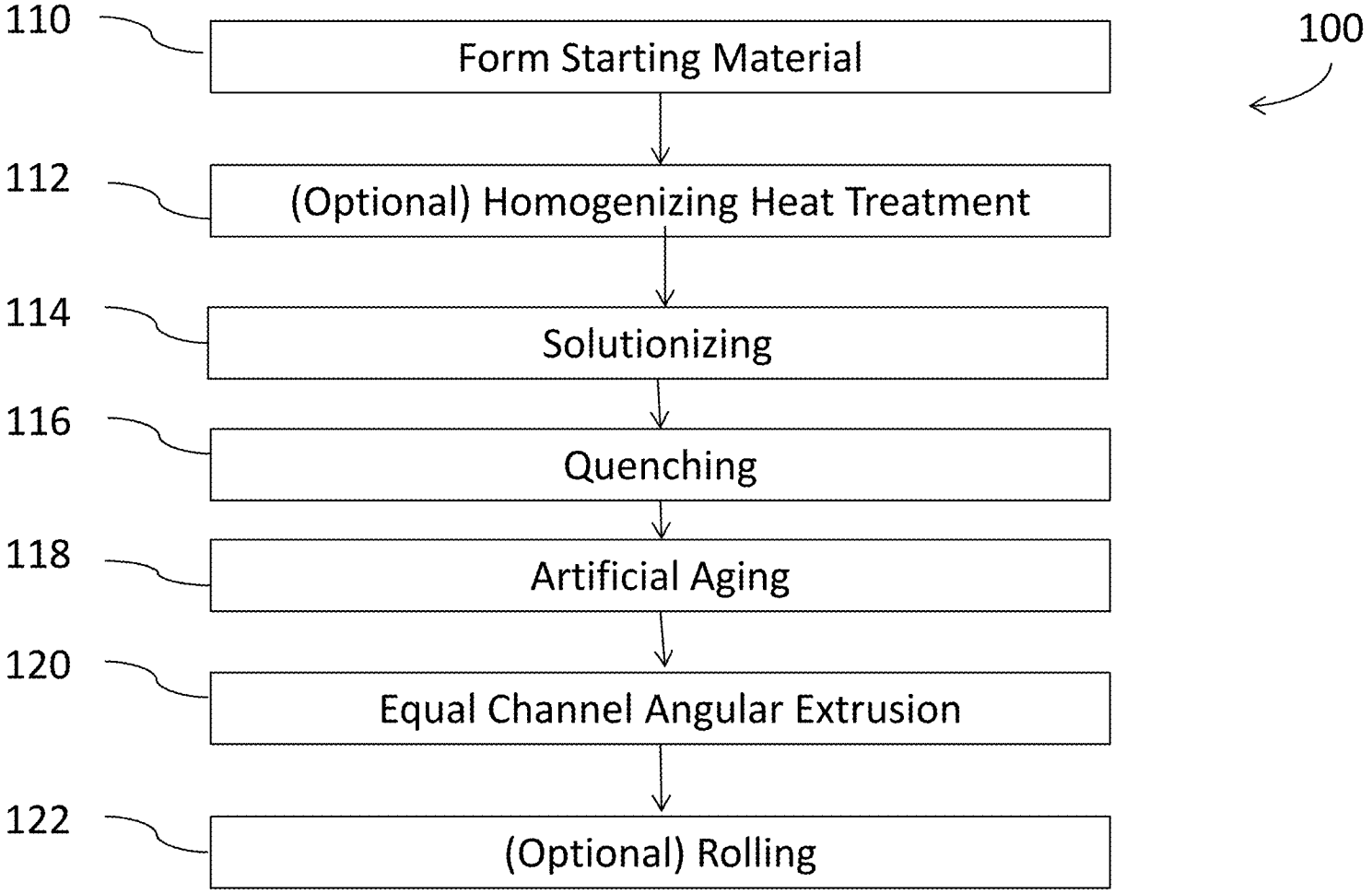
FIG. 1 is a flow chart showing an embodiment of a method of forming a high-strength aluminum alloy.

Disclosed herein is a method of forming an aluminum (Al) alloy that has high yield strength. More particularly, described herein is a method of forming an aluminum alloy that has a yield strength from about 300 MPa to about 650 MPa. In some embodiments, the aluminum alloy contains aluminum as a primary component and at least one secondary component. For example, the aluminum alloy may contain magnesium (Mg), manganese (Mn), silicon (Si), copper (Cu), and/or zinc (Zn) as a secondary component at a concentration of at least 0.1 wt. % with a balance of aluminum. In some examples, the aluminum may be present at a weight percentage greater than about 70 wt. %, greater than about 80 wt. %, or greater than bout 90 wt. %. Methods of forming a high strength aluminum alloy including by equal channel angular extrusion (ECAE) are also disclosed. Methods of forming a high strength aluminum alloy having a yield strength from about 300 MPa to about 650 MPa, including by equal channel angular extrusion (ECAE) in combination with certain heat treatment processes, are also disclosed. In some embodiments, the aluminum alloy may be cosmetically appealing. For example, the aluminum alloy may be free of a yellow or yellowish color.

In some embodiments, the methods disclosed herein may be carried out on an aluminum alloy having a composition containing aluminum as a primary component and zinc and magnesium as secondary components. For example, the aluminum alloy may contain zinc in the range from 2.0 wt. % to 7.5 wt. %, from about 3.0 wt. % to about 6.0 wt. %, or from about 4.0 wt. % to about 5.0 wt. %; and magnesium in the range from 0.5 wt. % to about 4.0 wt. %, from about 1.0 wt. % to 3.0 wt %, from about 1.3 wt. % to about 2.0 wt. %. For example, the aluminum alloy may be one of an Al 7xxx series of alloys. In some embodiments, the methods disclosed herein may be carried out with an aluminum alloy having a Zinc-to-magnesium weight ratio from about 3:1 to about 7:1, from about 4:1 to about 6:1, or about 5:1. In some embodiments, the methods disclosed herein may be carried out on an aluminum alloy having magnesium and zinc and having copper (Cu) in limited concentrations. For example, copper may be present at a concentration of less than about 1.0 wt. %, less than 0.5 wt. %, less than 0.2 wt. %, less than 0.1 wt. %, or less than 0.05 wt. %.

In some embodiments, the aluminum alloy may have a yield strength from about 400 MPa to about 650 MPa, from about 420 MPa to about 600 MPa, or from about 440 MPa to about 580 MPa. In some embodiments, the methods disclosed herein may be carried out with an aluminum alloy in the Al 7xxx series and form an aluminum alloy having a submicron grain size less than about 1 μm in diameter. For example, the grain size may be from about 0.2 μm to about 0.8 μm.

In some embodiments, the methods disclosed herein may be carried out on an aluminum alloy having a composition containing aluminum as a primary component and magnesium and silicon as secondary components. For example, the aluminum alloy may have a concentration of magnesium of at least 1.0 wt. %. For example, the aluminum alloy may have a concentration of magnesium in the range from about 0.3 wt. % to about 3.0 wt. %, 0.5 wt. % to about 2.0 wt. %, or 0.5 wt. % to about 1.5 wt. % and a concentration of silicon in the range from about 0.2 wt. % to about 2.0 wt. % or 0.4 wt. % to about 1.5 wt. %. For example, the aluminum alloy may be one of an Al 6xxx series alloy. In some embodiments, the aluminum alloy may have a yield strength from about 300 MPa to about 600 MPa, from about 350 MPa to about 600 MPa, or from about 400 MPa to about 550 MPa.

In some embodiments, the methods disclosed herein may be carried out on an aluminum alloy having aluminum as a primary component and copper as a secondary component. For example, the aluminum alloy may have a composition containing a concentration of copper in the range from about 0.5 wt. % to about 7.0 wt. % or from about 2.0 wt. % to about 6.5 wt. %. For example, the aluminum alloy may be one of an Al 2xxx series alloy. In some embodiments, the aluminum alloy may have a yield strength from about 300 MPa to about 650 MPa, from about 350 MPa to about 600 MPa, or from about 350 MPa to about 550 MPa.

In other embodiments, the methods disclosed herein may be carried out on an aluminum alloy having aluminum as a primary component and magnesium and manganese as secondary components. For example, the aluminum alloy may have a composition containing a concentration of magnesium in the range from about 0.5 wt. % to about 7.0 wt. %, from about 1.0 wt. % to about 5.5 wt. %, or from about 4.0 wt. % to about 5.5 wt. % and manganese in the range from about 0.1 wt. % to about 2.0 wt. % or from about 0.25 wt. % to about 1.5 wt. %. For example, the aluminum alloy may be one of an Al 3xxx series or Al 5xxx series alloy. In some embodiments, the aluminum alloy may have a yield strength from about 300 MPa to about 550 MPa, from about 350 MPa to about 500 MPa, or from about 400 MPa to about 500 MPa.

A method 100 of forming a high strength aluminum alloy having magnesium and zinc is shown in FIG. 1. The method 100 includes forming a starting material in step 110. For example, an aluminum material may be cast into a billet form. The aluminum material may include additives, such as other elements, which will alloy with aluminum during method 100 to form an aluminum alloy. In some embodiments, the aluminum material billet may be formed using standard casting practices for an aluminum alloy having magnesium and zinc, such as an aluminum-zinc alloy. However, in other embodiments, the aluminum material billet may be formed using standard casting practices for an aluminum alloy having magnesium, manganese, silicon, copper, and/or zinc.

After formation, the aluminum material billet may optionally be subjected to a homogenizing heat treatment in step 112. The homogenizing heat treatment may be applied by holding the aluminum material billet at a suitable temperature above room temperature for a suitable time to improve the aluminum's hot workability in following steps. The temperature and time of the homogenizing heat treatment may be specifically tailored to a particular alloy. The temperature and time may be sufficient such that the secondary components are dispersed throughout the aluminum material to form a solutionized aluminum material. For example, the secondary components may be dispersed throughout the aluminum material such that the solutionized aluminum material is substantially homogenous. In some embodiments, a suitable temperature for the homogenizing heat treatment may be from about 300° C. to about 500° C. The homogenizing heat treatment may improve the size and homogeneity of the as-cast microstructure that is usually dendritic with micro and macro segregations. Certain homogenizing heat treatments may be performed to improve structural uniformity and subsequent workability of billets. In some embodiments, a homogenizing heat treatment may lead to the precipitation occurring homogenously, which may contribute to a higher attainable strength and better stability of precipitates during subsequent processing.

In some embodiments, after the homogenizing heat treatment, the aluminum material billet may be subjected to solutionizing in step 114. The goal of solutionizing is to dissolve the additive elements, such as magnesium, manganese, silicon, copper, and/or zinc into the aluminum material to form an aluminum alloy. A suitable solutionizing temperature may be from about 400° C. to about 550° C., from about 420° C. to about 500° C., or from about 450° C. to about 480° C. Solutionizing may be carried out for a suitable duration based on the size, such as the cross sectional area, of the billet. For example, the solutionizing may be carried out for from about 30 minutes to about 8 hours, from 1 hour to about 6 hours, or from about 2 hours to about 4 hours, depending on the cross section of the billet. As an example, the solutionizing may be carried out at 450° C. to about 480° C. for up to 8 hours.

The solutionizing may be followed by quenching, as shown in step 116. For standard metal casting, heat treatment of a cast piece is often carried out near the solidus temperature (i.e. solutionizing) of the cast piece, followed by rapidly cooling the cast piece by quenching the cast piece to about room temperature or lower. This rapid cooling retains any elements dissolved into the cast piece at a higher concentration than the equilibrium concentration of that element in the aluminum alloy at room temperature.

In some embodiments, aging may be optionally carried out after the aluminum alloy billet is quenched and before the ECAE process, as shown in step 118. In one example, aging may be carried out using a one-step heat treatment. In some embodiments, the one-step heat treatment may be carried out at temperatures from about 80° C. to about 200° C. for a duration of 0.25 hours to about 40 hours. In other examples, aging may be carried out using a two-step heat treatment. For example, a first heat treatment step may be carried out at temperatures from about 80° C. to about 100° C., from about 85° C. to about 95° C., or from about 88° C. to about 92° C., for a duration of from 1 hour to about 50 hours, from about 8 hours to about 40 hours, or from about 10 hours to about 20 hours. In some embodiments, a second heat treatment step may be carried out at temperatures from about 100° C. to about 170° C., from about 100° C. to about 160° C., or from about 110° C. to about 160° C. for a duration of from 20 hours to about 100 hours, from about 35 hours to about 60 hours, or from about 40 hours to about 45 hours. For example, the first step may be carried out at about 90° C. for about 8 hours and the second step may be carried out at about 115° C. for about 40 hours or less. Generally, a first aging heat treatment step may be carried out at a lower temperature and for less time than the temperature and duration that the second artificial aging heat treatment step is carried out at. In some embodiments, the second aging heat treatment step may include temperatures and time that are less than or equal to conditions suitable for aging an aluminum alloy to peak hardness (i.e., peak aging).

In some embodiments, the aluminum alloy billet may be subjected to severe plastic deformation such as equal channel angular extrusion (ECAE), as shown in step 120. For example, the aluminum alloy billet may be passed through an ECAE device to extrude the aluminum alloy as a billet having a square or circular cross section. The ECAE process may be carried out at relatively low temperatures compared to the solutionizing temperature of the particular aluminum alloy being extruded. For example, ECAE of an aluminum alloy having magnesium and zinc may be carried out at a temperature of from about 0° C. to about 200° C., from about 20° C. to about 150° C., or from about 20° C. to about 125° C., or about room temperature, for example, from about 20° C. to about 35° C. In some embodiments, during the extrusion, the aluminum alloy material being extruded and the extrusion die may be maintained at the temperature that the extrusion process is being carried out at to ensure a consistent temperature throughout the aluminum alloy material. That is, the extrusion die may be heated to prevent the aluminum alloy material from cooling during the extrusion process. In some embodiments, the ECAE process may include one pass, two or more passes, or four or more extrusion passes through the ECAE device.

Following severe plastic deformation by ECAE, the aluminum alloy may optionally undergo further plastic deformation, such as rolling in step 122, to further tailor the aluminum alloy properties and/or change the shape or size of the aluminum alloy. Cold working (such as stretching) may be used to provide a specific shape or to stress relief or straighten the aluminum alloy billet. For plate applications where the aluminum alloy is to be a plate, rolling may be used to shape the aluminum alloy.

Figure 2:
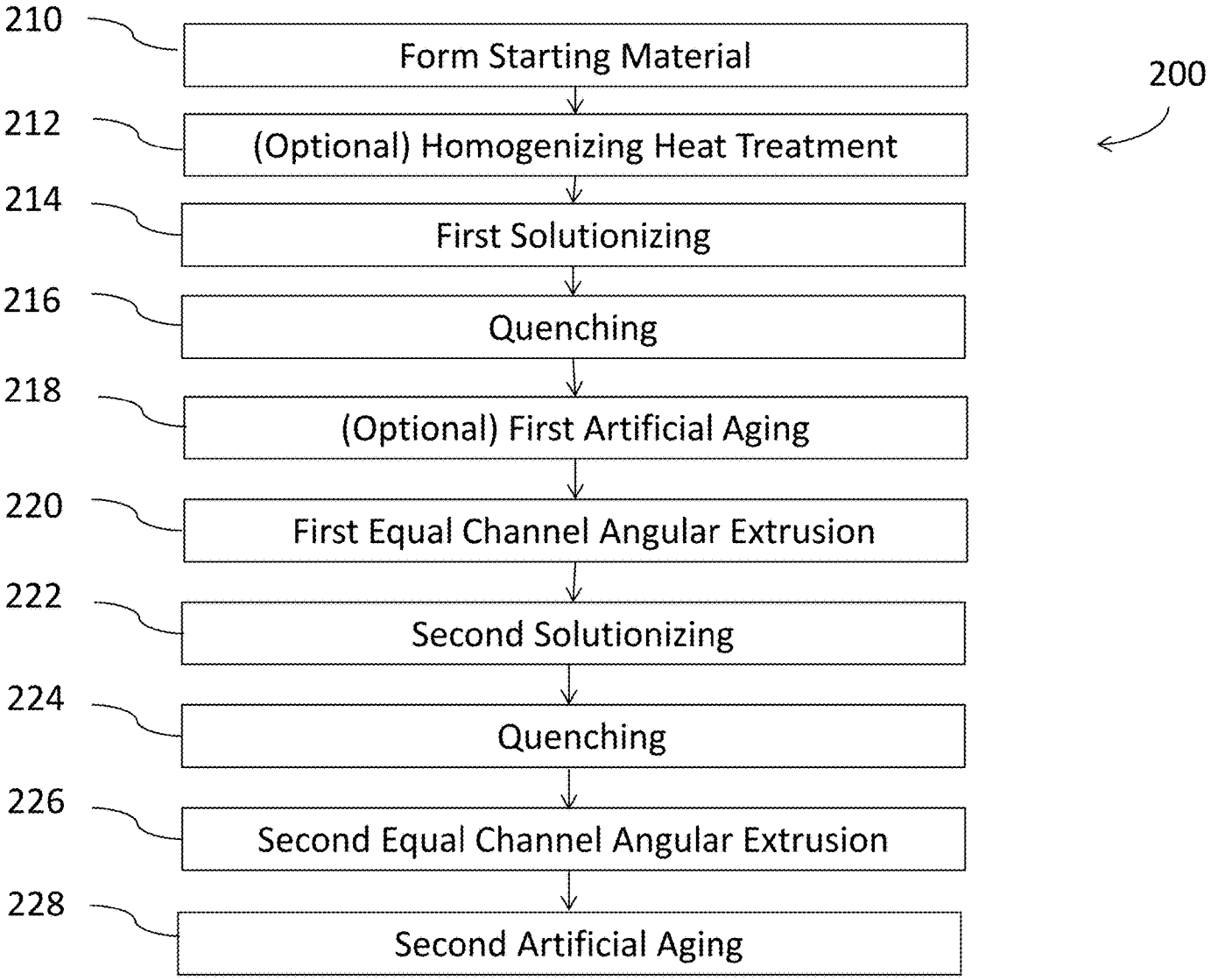
FIG. 2 is a flow chart showing an alternative embodiment of a method of forming a high-strength aluminum alloy.

FIG. 2 is a flow chart of a method 200 of forming a high strength aluminum alloy. The method 200 includes forming a starting material in step 210. Step 210 may be the same as or similar to step 110 described herein with respect to FIG. 1. In some embodiments, the starting material may be an aluminum material billet formed using standard casting practices for an aluminum material having magnesium and zinc, such as aluminum-zinc alloys. However, in other embodiments, the aluminum material billet may be formed using standard casting practices for an aluminum alloy having magnesium, manganese, silicon, copper, and/or zinc.

The starting material may be optionally subjected to a homogenizing heat treatment in step 212. This homogenizing heat treatment may be applied by holding the aluminum material billet at a suitable temperature above room temperature to improve the aluminum's hot workability. Homogenizing heat treatment temperatures may be in the range of 300° C. to about 500° C. and may be specifically tailored to particular aluminum alloys.

After the homogenzing heat treatment, the aluminum material billet may be optionally subjected to a first solutionizing in step 214. The goal of solutionizing is to dissolve the additive elements, such as magnesium, manganese, silicon, copper, and/or zinc, zincmagnesium to form an aluminum alloy. A suitable first solutionizing temperature may be from about 400° C. to about 550° C., from about 420° C. to about 500° C., or from about 450° C. to about 480° C. Solutionizing may be carried out for a suitable duration based on the size, such as the cross sectional area, of the billet. For example, the first solutionizing may be carried out for from about 30 minutes to about 8 hours, from 1 hour to about 6 hours, or from about 2 hours to about 4 hours, depending on the cross section of the billet. As an example, the first solutionizing may be carried out at 450° C. to about 480° C. for up to 8 hours.

The first solutionizing may be followed by quenching, as shown in step 216. This rapid cooling retains any elements dissolved into the cast piece at a higher concentration than the equilibrium concentration of that element in the aluminum alloy at room temperature.

In some embodiments, after the aluminum alloy billet is quenched, aging may optionally be carried out in step 218. In one example, aging may be carried out using a one-step heat treatment. In some embodiments, the one-step heat treatment may be carried out at temperatures from about 80°

C. to about 200° C. for a duration of 0.25 hours to about 40 hours. Aging may be carried out using a two-step heat treatment. In some embodiments, a first heat treatment step may be carried out at temperatures from about 80° C. to about 100° C., from about 85° C. to about 95° C., or from about 88° C. to about 92° C., for a duration of from 1 hour to about 50 hours, from about 8 hours to about 40 hours, or from about 8 hours to about 20 hours. In some embodiments, a second heat treatment step may be carried out at temperatures from about 100° C. to about 170° C., from about 100° C. to about 160° C., or from about 110° C. to about 160° C. for a duration of from 20 hours to about 100 hours, from about 35 hours to about 60 hours, or from about 40 hours to about 45 hours. For example, the first step may be carried out at about 90° C. for about 8 hours and the second step may be carried out at about 115° C. for about 40 hours or less. Generally, a first aging heat treatment step may be carried out at a lower temperature and for less time than the temperature and duration that the second artificial aging heat treatment step is carried out at. In some embodiments, the second aging heat treatment step may include temperatures and time that are less than or equal to conditions suitable for artificially aging an aluminum alloy.

As shown in FIG. 2, after quenching in step 216, or after the optional aging in step 218, the aluminum alloy may be subjected to a first severe plastic deformation process, such as an ECAE process, in step 220. ECAE may include passing the aluminum alloy billet through an ECAE device in a particular shape, such as a billet having a square or circular cross section. In some embodiments, this first ECAE process may be carried out at temperatures below the homogenizing heat treatment but above the artificial aging temperature of the aluminum alloy. In some embodiments, this first ECAE process may be carried out at temperatures of from about 100° C. to about 400° C., or from about 150° C. to about 300° C., or from about 200° C. to about 250° C. In some embodiments, the first ECAE process may refine and homogenize the microstructure of the alloy and may provide a better, more uniform, distribution of solutes and microsegregations. In some embodiments, this first ECAE process may be performed on an aluminum alloy at temperatures higher than 300° C. Processing aluminum alloys at temperatures higher than about 300° C. may provide advantages for healing of cast defects and redistribution of precipitates, but may also lead to coarser grain sizes and may be more difficult to implement in processing conditions. In some embodiments, during the extrusion process, the aluminum alloy material being extruded and the extrusion die may be maintained at the temperature that the extrusion process is being performed at to ensure a consistent temperature throughout the aluminum alloy material. That is, the extrusion die may be heated to prevent the aluminum alloy material from cooling during the extrusion process. In some embodiments, the first ECAE process may include one, two or more, or four or more extrusion passes.

In some embodiments, after a first severe plastic deformation, the aluminum alloy may be optionally subjected to a second solutionizing in step 222. The second solutionizing may be carried out on the aluminum alloy at similar temperature and time conditions as the first solutionizing. In some embodiments, the second solutionizing may be carried out at a temperature and/or duration that are different than the first solutionizing. In some embodiments, a suitable second solutionizing temperature may be from about 400° C. to about 550° C., from about 420° C. to about 500° C., or from about 450° C. to about 480° C. A second solutionizing may be carried out for a suitable duration based on the size, such as the cross sectional area, of the billet. For example, the second solutionizing may be carried out for from about 30 minutes to about 8 hours, from 1 hour to about 6 hours, or from about 2 hours to about 4 hours, depending on the cross section of the billet. In some embodiments, the second solutionizing may be from about 450° C. to about 480° C. for up to 8 hours. In various embodiments, the second solutionizing may be followed by quenching.

In some embodiments, after the second solutionizing and/or the quenching, the aluminum alloy may be optionally subjected to a second severe plastic deformation step, such as an ECAE process, in step 226. In some embodiments, the second ECAE process may be carried out at lower temperatures than that used in the first ECAE process of step 220. For example, the second ECAE process may be carried out at temperatures greater than 0° C. and less than 200° C., or from about 20° C. to about 125° C., or from about 20° C. to about 100° C., or about room temperature, for example from about 20° C. to about 35° C. In some embodiments, during the extrusion, the aluminum alloy material being extruded and the extrusion die may be maintained at the temperature that the extrusion process is being carried out at to ensure a consistent temperature throughout the aluminum alloy material. That is, the extrusion die may be heated to prevent the aluminum alloy material from cooling during the extrusion process. In some embodiments, the second ECAE process may include one pass, two or more passes, or four or more extrusion passes through the ECAE device.

In some embodiments, after the aluminum alloy is submitted to a second severe plastic deformation step such as ECAE, a second aging process may be optionally carried out in step 228. In one example, aging may be carried out using a one-step heat treatment. In some embodiments, the one-step heat treatment may be carried out at temperatures from about 80° C. to about 200° C. for a duration of 0.25 hours to about 40 hours. In some embodiments, aging may be carried out using a two-step heat treatment. In some embodiments, a first heat treatment step may be carried out at temperatures from about 80° C. to about 100° C., from about 85° C. to about 95° C., or from about 88° C. to about 92° C., for a duration of from 1 hour to about 50 hours, from about 8 hours to about 40 hours, or from about 8 hours to about 20 hours. In some embodiments, a second heat treatment step may be carried out at temperatures from about 100° C. to about 170° C., from about 100° C. to about 160° C., or from about 110° C. to about 160° C. for a duration of from 20 hours to about 100 hours, from about 35 hours to about 60 hours, or from about 40 hours to about 45 hours. For example, the first aging step may be carried out at about 90° C. for about 8 hours and the second aging may be carried out at about 115° C. for about 40 hours or less. In some embodiments, the second step may include temperatures and time that are less than or equal to conditions suitable for artificially aging an aluminum alloy to peak hardness (i.e., peak hardness).

Following method 200, the aluminum alloy may optionally undergo further plastic deformation, such as rolling to change the shape or size of the aluminum alloy.

Figure 3:
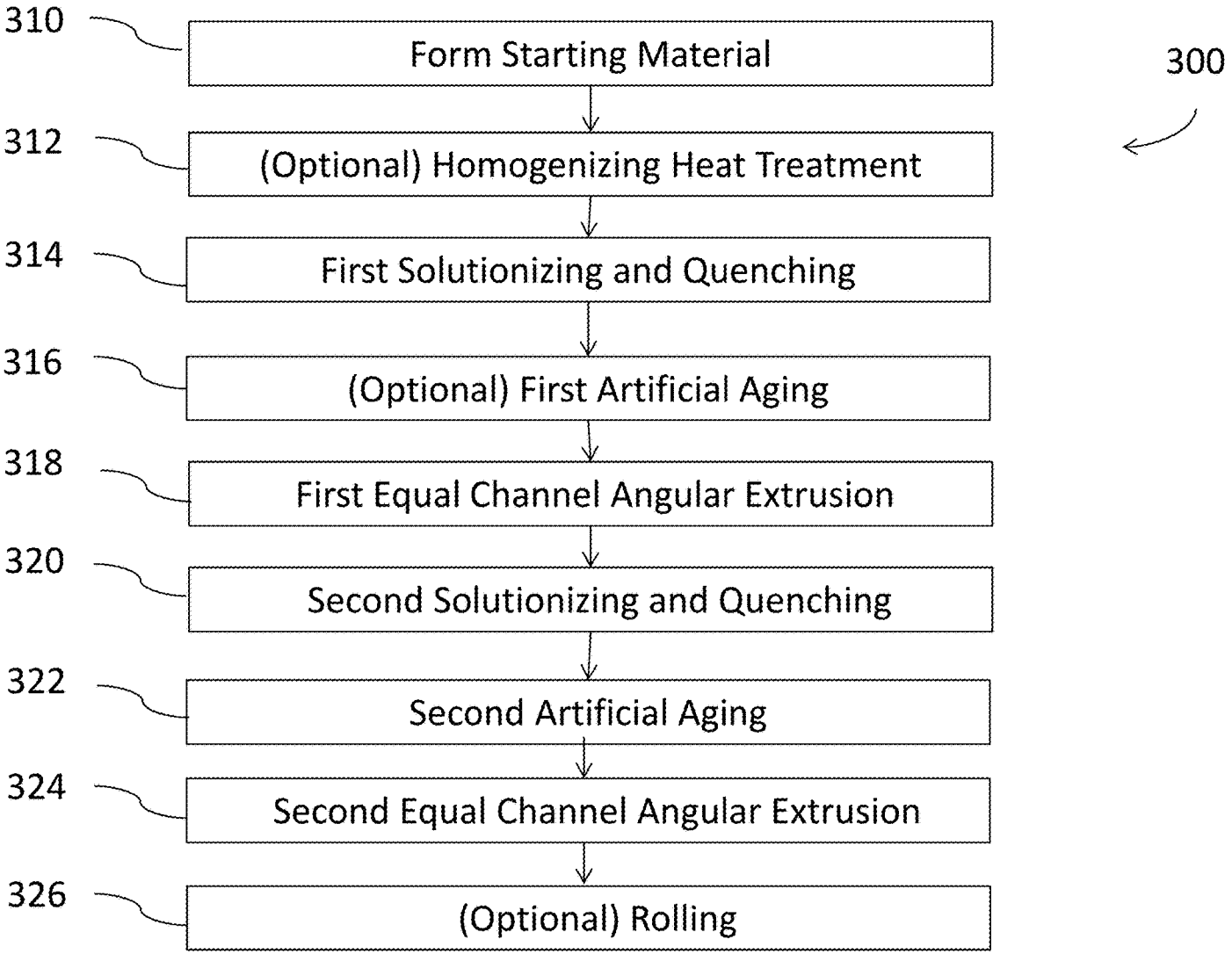
FIG. 3 is a flow chart showing an alternative embodiment of a method of forming a high-strength aluminum alloy.

A method 300 of forming a high strength aluminum alloy is shown in FIG. 3. The method 300 may include casting a starting material in step 310. For example, an aluminum material may be cast into a billet form. The aluminum material may include additives, such as other elements, which will alloy with the aluminum during method 310 to form an aluminum alloy. In some embodiments, the aluminum material billet may be formed using standard casting practices for an aluminum alloy having magnesium and zinc, such as aluminum-zinc alloys, for example Al 7xxx series aluminum alloys. However, in other embodiments, the aluminum material billet may be formed using standard casting practices for an aluminum alloy having at least one of magnesium, manganese, copper, and/or zinc such as, for example, Al 2xxx, Al 3xxx, Al 5xxx, or Al 6xxx series alloys.

After formation, the aluminum material billet may be subjected to a homogenizing heat treatment in step 312. The homogenizing heat treatment may be applied by holding the aluminum material billet at a suitable temperature above room temperature to improve the aluminum's hot workability in following steps. The homogenizing heat treatment may be specifically tailored to a specific aluminum alloy. For example, the temperature may vary depending on the composition of the aluminum alloy or which series of alloy is used. In some embodiments, a suitable temperature for the homogenizing heat treatment may be from about 300° C. to about 500° C.

After the homogenizing heat treatment, the aluminum material billet may be subjected to a first solutionizing in step 314 to form an aluminum alloy. The first solutionizing may be similar to that described herein with respect to steps 114 and 214. A suitable first solutionizing temperature may be from about 400° C. to about 550° C., from about 420° C. to about 500° C., or from about 450° C. to about 480° C. A first solutionizing may be carried out for a suitable duration based on the size, such as the cross sectional area, of the billet. For example, the first solutionizing may be carried out for from about 30 minutes to about 8 hours, from 1 hour to about 6 hours, or from about 2 hours to about 4 hours, depending on the cross section of the billet. As an example, the solutionizing may be carried out at 450° C. to about 480° C. for up to 8 hours. The solutionizing may be followed by quenching. During quenching, the aluminum alloy billet is rapidly cooled by quenching the aluminum alloy billet is cooled to about room temperature or lower. This rapid cooling retains any elements dissolved into the aluminum alloy at a higher concentration than the equilibrium concentration of that element in the aluminum alloy at room temperature. In some embodiments, the quenching may occur within 24 hours of the first solutionizing.

In some embodiments, after the aluminum alloy is quenched, aging may optionally be carried out in step 316. In one example, aging may be carried out using a one-step heat treatment. In some embodiments, the one-step heat treatment may be carried out at temperatures from about 80° C. to about 200° C. for a duration of 0.25 hours to about 40 hours. In some embodiments, aging may be carried out with two heat treatment steps that form the artificial aging step. In some embodiments, a first heat treatment step may be carried out at temperatures from about 80° C. to about 100° C., from about 85° C. to about 95° C., or from about 88° C. to about 92° C., for a duration of from 1 hour to about 50 hours, from about 8 hours to about 40 hours, or from about 8 hours to about 20 hours. In some embodiments, a second heat treatment step may be carried out at temperatures from about 100° C. to about 170° C., from about 100° C. to about 160° C., or from about 110° C. to about 160° C. for a duration of from 20 hours to about 100 hours, from about 35 hours to about 60 hours, or from about 40 hours to about 45 hours. For example, the first step may be carried out at about 90° C. for about 8 hours and the second step may be carried out at about 115° C. for about 40 hours or less. Generally, a first aging heat treatment step may be carried out at a lower temperature and for less time than the temperature and duration that the second aging heat treatment step is carried out at. In some embodiments, the second aging heat treatment step may include temperatures and time that are less than or equal to conditions suitable for aging an aluminum alloy to peak hardness (i.e., peak aging).

After aging, the aluminum alloy billet may be subjected to severe plastic deformation, such as a first ECAE process, in step 318. For example, the aluminum alloy billet may be passed through an ECAE device to extrude the aluminum alloy as a billet having a square or circular cross section. In some embodiments, a first ECAE process may be carried out at elevated temperatures, for example, temperatures below the homogenizing heat treatment but above the aging temperature of a particular aluminum-zinc alloy. In some embodiments, the first ECAE process may be carried out with the aluminum alloy maintained at temperatures from about 100° C. to about 400° C., or from about 200° C. to about 300° C. In some embodiments, the first ECAE process may be carried out with the aluminum alloy maintained at temperatures higher than 300° C. Temperatures at this level may provide certain advantages, such as healing of cast defects and redistribution of precipitates, but may also lead to coarser grain sizes and may be more difficult to implement in processing conditions. In some embodiments, during the extrusion, the aluminum alloy material being extruded and the extrusion die may be maintained at the temperature that the extrusion process is being carried out at to ensure a consistent temperature throughout the aluminum alloy material. That is, the extrusion die may be heated to prevent the aluminum alloy material from cooling during the extrusion process. In some embodiments, the first ECAE process may include one pass, two or more passes, or four or more extrusion passes through the ECAE device.

In some embodiments, after severe plastic deformation, the aluminum alloy may be subjected to a second solutionizing in step 320. A suitable second solutionizing temperature may be from about 400° C. to about 550° C., from about 420° C. to about 500° C., or from about 450° C. to about 480° C. A second solutionizing may be carried out for a suitable duration based on the size, such as the cross sectional area, of the billet. For example, the second solutionizing may be carried out for from about 30 minutes to about 8 hours, from 1 hour to about 6 hours, or from about 2 hours to about 4 hours, depending on the cross section of the billet. In some embodiments, the second solutionizing may be from about 450° C. to about 480° C. for up to 8 hours. The second solutionizing may be followed by quenching.

In some embodiments, after the second solutionizing and/or the quenching, a second aging heat treatment step may be carried out in step 322. In one example, aging may be carried out using a one-step heat treatment. In some embodiments, the one-step heat treatment may be carried out at temperatures from about 80° C. to about 200° C. for a duration of 0.25 hours to about 40 hours. In some embodiments, the second aging may be carried out using a two-step heat treatment. In some embodiments, a first heat treatment step may be carried out at temperatures from about 80° C. to about 100° C., from about 85° C. to about 95° C., or from about 88° C. to about 92° C., for a duration of from 1 hour to about 50 hours, from about 8 hours to about 40 hours, or from about 8 hours to about 20 hours. In some embodiments, a second heat treatment step may be carried out at temperatures from about 100° C. to about 170° C., from about 100° C. to about 160° C., or from about 110° C. to about 160° C. for a duration of from 20 hours to about 100 hours, from about 35 hours to about 60 hours, or from about 40 hours to about 45 hours. For example, the first aging step may be carried out at about 90° C. for about 8 hours and the second aging may be carried out at about 115° C. for about 40 hours or less. In some embodiments, the second step may include temperatures and time that are less than or equal to conditions suitable for aging an aluminum alloy to peak hardness (i.e., peak hardness).

In some embodiments, after the second aging process, the aluminum alloy may be subjected to a second severe plastic deformation process, such as a second ECAE process, in step 324. In some embodiments, the second ECAE process may be carried out at lower temperatures than that used in the first ECAE process. For example, the second ECAE process may be carried out at temperatures greater than 0° C. and less than 200° C., or from about 20° C. to about 125° C., or about room temperature, for example from about 20° C. to about 35° C. In some embodiments, during the extrusion, the aluminum alloy material being extruded and the extrusion die may be maintained at the temperature that the extrusion process is being carried out at to ensure a consistent temperature throughout the aluminum alloy material. That is, the extrusion die may be heated to prevent the aluminum alloy material from cooling during the extrusion process. In some embodiments, the second ECAE process may include one pass, two or more passes, or four or more extrusion passes through the ECAE device.

Following the second severe plastic deformation, the aluminum alloy may optionally undergo further plastic deformation in step 326, such as rolling, to change the shape or size of the aluminum alloy.

Figure 4:
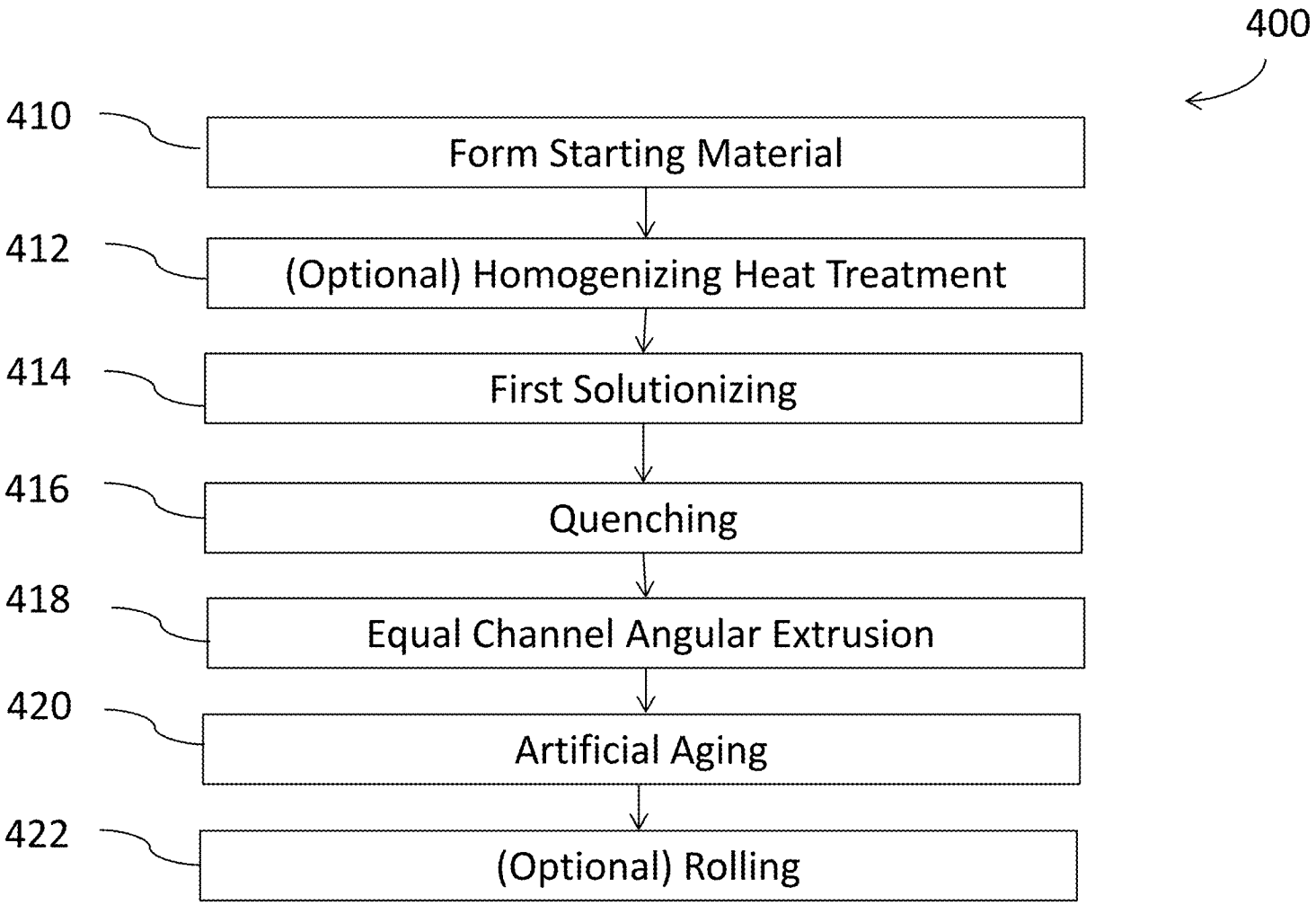
FIG. 4 is a flow chart showing an alternative embodiment of a method of forming a high-strength metal alloy.

A method of forming a high strength aluminum alloy is shown in FIG. 4. The method 400 includes forming a starting material in step 410. Step 410 may be the same or similar to steps 110 or 210 described herein with respect to FIGS. 1 and 2. In some embodiments, the starting material may be an aluminum material billet formed using standard casting practices for an aluminum material having magnesium, manganese, copper, and/or zinc. After the starting material is cast, a homogenizing heat treatment may optionally be employed in step 412. Step 412 may be the same or similar to steps 112 or 212 described herein with respect to FIGS. 1 and 2.

After the homogenizing heat treatment, the aluminum material may be subjected to a first solutionizing in step 414, to form an aluminum alloy. A suitable first solutionizing temperature may be from about 400° C. to about 550° C., from about 420° C. to about 500° C., or from about 450° C. to about 480° C. A first solutionizing may be carried out for a suitable duration based on the size, such as the cross sectional area, of the billet. For example, the first solutionizing may be carried out for from about 30 minutes to about 8 hours, from 1 hour to about 6 hours, or from about 2 hours to about 4 hours, depending on the cross section of the billet. As an example, the solutionizing may be carried out at 450° C. to about 480° C. for up to 8 hours. The solutionizing may be followed by quenching, as shown in step 416.

In some embodiments, after the solutionizing and quenching, the aluminum alloy billet may be subjected to a severe plastic deformation process in step 418. In some embodiments, the severe plastic deformation process may be ECAE. For example, the aluminum alloy billet may be passed through an ECAE device having a square or circular cross section. For example, an ECAE process may include one or more ECAE passes. In some embodiments, the ECAE process may be carried out with the aluminum alloy billet at temperatures greater than 0° C. and less than 160° C., or from about 20° C. to about 125° C., or about room temperature, for example from about 20° C. to about 35° C. In some embodiments, during the ECAE, the aluminum alloy billet being extruded and the extrusion die may be maintained at the temperature that the extrusion process is being carried out at to ensure a consistent temperature throughout the aluminum alloy billet. That is, the extrusion die may be heated to prevent the aluminum alloy from cooling during the extrusion process. In some embodiments, the ECAE process may include one pass, two or more passes, or four or more extrusion passes through the ECAE device.

In some embodiments, after the aluminum alloy is subjected to severe plastic deformation in step 418, aging may be carried out in step 420. In one example, aging may be carried out using a one-step heat treatment. In some embodiments, the one-step heat treatment may be carried out at temperatures from about 80° C. to about 200° C. for a duration of 0.25 hours to about 40 hours. In some embodiments, aging may be carried out using a two-step heat treatment. In some embodiments, a first heat treatment step may be carried out at temperatures from about 80° C. to about 100° C., from about 85° C. to about 95° C., or from about 88° C. to about 92° C., for a duration of from 1 hour to about 50 hours, from about 8 hours to about 40 hours, or from about 8 hours to about 20 hours. In some embodiments, a second heat treatment step may be carried out at temperatures from about 100° C. to about 170° C., from about 100° C. to about 160° C., or from about 110° C. to about 160° C. for a duration of from 20 hours to about 100 hours, from about 35 hours to about 60 hours, or from about 40 hours to about 45 hours. For example, the first aging step may be carried out at about 90° C. for about 8 hours and the second aging may be carried out at about 115° C. for about 40 hours or less. In some embodiments, the second step may include temperatures and time that are less than or equal to conditions suitable for aging an aluminum alloy to peak hardness (i.e., peak hardness).

Following aging, the aluminum alloy may optionally undergo further plastic deformation in step 422, such as rolling, to change the shape or size of the aluminum alloy billet.

The methods shown in FIGS. 1 to 4 may be applied to aluminum alloys having one or more additional components. For example, the aluminum alloys may contain at least one of magnesium, manganese, silicon, copper, and zinc. In some embodiments, the methods of FIGS. 1 to 4 may be applied to aluminum alloys that are suitable for use in portable electronic device cases due to high yield strength (i.e., a yield strength from 300 MPa to 650 MPa), a low weight density (i.e., about 2.8 g/cm$^3$), and relative ease of manufacturing to complex shapes.

In addition to the mechanical strength requirements, there may also be a desire for the aluminum alloy to meet particular cosmetic appearance requirements, such as a desired color or shade. For example, in the portable electronics area, there may be a desire for an outer alloy case to have a specific color or shade without the use of paint or other coatings.

Therefore, the specific alloy used in various applications may depend on the characteristics desired. For example, it has been found that copper-containing aluminum alloys often display a yellowish color after being anodized. In other examples where a yellowish color is not desired, aluminum-zinc alloys may be used due to a lower concentration of copper. To facilitate the desired coloring characteristics in aluminum-zinc alloys, the concentration of copper must be kept relatively low. For example, in some embodiments, the concentration of copper may be less than about 0.5 wt. %. The weight percentages and weight ratio of zinc and magnesium in the aluminum alloy may also be carefully controlled. For example, zinc and magnesium may cause an increase in strength by forming zinc-magnesium precipitates such as $MgZn_2$ that increase the strength of the aluminum alloy by precipitation hardening. However, too high of a concentration of zinc and magnesium may, in some embodiments, decrease the resistance of the alloy to stress corrosion during specific manufacturing steps, such as anodizing.

As-cast yield strengths for aluminum alloys containing and Magnesium have been found to be between about 50 MPa and 450 MPa. As-cast yield strengths for aluminum alloys containing copper have been found to be between about 50 MPa and 400 MPa. As-cast yield strengths for aluminum alloys containing magnesium and manganese have been found to be between about 50 MPa and 350 Mpa. Using the methods disclosed herein, it has been found possible to further increase the strength of aluminum alloys, thus the resulting alloy may be attractive for use in electronic device cases. For example, using the methods described with reference to FIGS. 1 to 4, yield strengths of 300 MPa to 650 MPa, 300 MPa to 500 MPa, 350 MPa to 600 MPa, and 420 MPa to 500 MPa have been achieved with aluminum alloys containing at least one of magnesium, manganese, silicon, copper, and zinc.

As described herein the mechanical properties of these aluminum alloys can be improved by subjecting the alloy to severe plastic deformation (SPD). As used herein, severe plastic deformation includes extreme deformation of bulk pieces of material. In some embodiments, ECAE provides suitable levels of desired mechanical properties when applied to the materials described herein.

Figure 5:
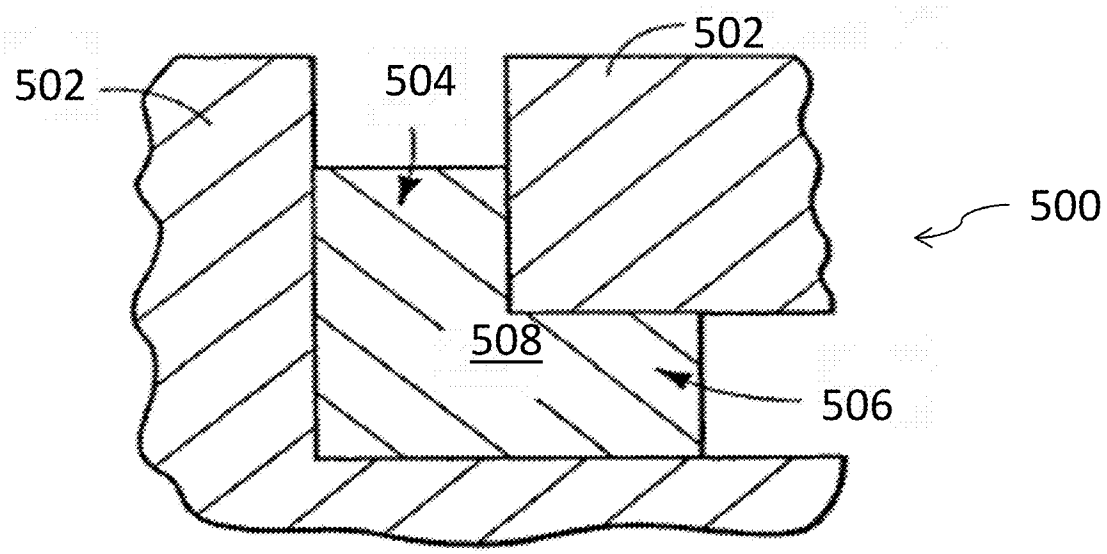
FIG. 5 is a schematic view of a sample equal channel angular extrusion device.

ECAE is an extrusion technique which consists of two channels of roughly equal cross-sections meeting at a certain angle comprised practically between 90° and 140°. An example ECAE schematic of an ECAE device 500 is shown in FIG. 5. As shown in FIG. 5, an exemplary ECAE device 500 includes a mold assembly 502 that defines a pair of intersecting channels 504 and 506. The intersecting channels 504 and 506 are identical or at least substantially identical in cross-section, with the term "substantially identical" indicating the channels are identical within acceptable size tolerances of an ECAE apparatus. In operation, a material 508 is extruded through channels 504 and 506. Such extrusion results in plastic deformation of the material 508 by simple shear, layer after layer, in a thin zone located at the crossing plane of the channels. In some embodiments, then channels 504 and 506 intersect at an angle of about 90° to produce a sufficient deformation (i.e., true shear strain). For example, a tool angle of 90° may result in true strain that is about 1.17 per each ECAE pass. However, it is to be understood that an alternative tool angle, for example an angle greater than 90°, can be used (not shown).

ECAE provides high deformation per pass, and multiple passes of ECAE can be used in combination to reach extreme levels of deformation without changing the shape and volume of the billet after each pass. Rotating or flipping the billet between passes allows various strain paths to be achieved. This allows control over the formation of the crystallographic texture of the alloy grains and the shape of various structural features such as grains, particles, phases, cast defects or precipitates. Grain refinement is enabled with ECAE by controlling three main factors: (i) simple shear, (ii) intense deformation and (iii) taking advantage of the various strain paths that are possible using multiple passes of ECAE. ECAE provides a scalable method, a uniform final product, and the ability to form a monolithic piece of material as a final product.

Because ECAE is a scalable process, large billet sections and sizes can be processed via ECAE. ECAE also provides uniform deformation throughout the entire billet cross-section because the cross-section of the billet can be controlled during processing to prevent changes in the shape or size of the cross-section. Also, simple shear is active at the intersecting plane between the two channels.

ECAE involves no intermediate bonding or cutting of the material being deformed. Therefore, the billet does not have a bonded interface within the body of the material. That is, the produced material is a monolithic piece of material with no bonding lines or interfaces where two or more pieces of previously separate material have been joined together. Interfaces can be detrimental because they are a preferred location for oxidation, which is often detrimental. For example, bonding lines can be a source for cracking or delamination. Furthermore, bonding lines or interfaces are responsible for non-homogeneous grain size and precipitation and result in anisotropy of properties.

In some instances, the aluminum alloy billet may crack during ECAE. In certain aluminum alloys, a high diffusion rate of constituents in the aluminum alloy may affect processing results. In some embodiments, carrying out ECAE at increased temperatures may avoid cracking of the aluminum alloy billet during ECAE. For example, increasing the temperature that the aluminum alloy billet is held at during extrusion may improve the workability of the aluminum alloy and make the aluminum alloy billet easier to extrude. However, increasing the temperature of the aluminum alloy generally leads to undesirable grain growth, and in heat treatable aluminum alloys, higher temperatures may affect the size and distribution of precipitates. The altered precipitate size and distribution may have a deleterious effect on the strength of the aluminum alloy after processing. This may be the result when the temperature and time used during ECAE are above the temperature and time that correspond to peak hardness for the aluminum alloy being processed, i.e. above the temperature and time conditions that correspond to peak aging. Carrying out ECAE on an aluminum alloy with the alloy at a temperature too close to the peak aging temperature of the aluminum alloy may thus not be a suitable technique for increasing the final strength of certain aluminum alloys even though it may improve the billet surface conditions (i.e. reduce the number of defects produced).

Processing an aluminum alloy via ECAE with the aluminum alloy held at about room temperature after an initial solutionizing and quenching may provide a suitable process for increasing the strength of the aluminum alloy. This technique may be fairly successful when a single ECAE pass is conducted almost immediately (i.e, within one hour) after the initial solutionizing and quenching treatments. However, this technique is not generally successful for certain alloy compositions or when multiple passes of ECAE are used. For example, for aluminum alloys having zinc and magnesium in weight concentrations close to the upper level for the Al 7xxx series (i.e., zinc and magnesium values of about 6.0 wt. % and 4.0 wt. %, respectively), it has been found that a single pass ECAE may not adequately increase the alloy strength or provide a sufficiently fine submicron structure.

In some embodiments, it may be beneficial to perform aging on an aluminum alloy before cold-working the alloy and if the alloy has been subjected to an initial solutionizing and quenching. One example of such an alloy is an aluminum alloy having magnesium and zinc and a low concentration of Cu. Aging may be beneficial in certain embodiments because the effects of cold working certain aluminum alloys, such as, for example, those in the Al 7xxx series, after solutionizing are the opposite of some other heat treatable aluminum alloys, such as Al 2xxx series alloys. For example, cold work may reduce the maximum attainable strength and toughness in overaged tempers of aluminum alloys. The negative effect of cold work before aging certain aluminum alloys is attributed to the nucleation of coarse precipitates on dislocations. The approach of using ECAE directly after solutionizing and quenching and before aging may therefore require particular parameters. This effect is shown further in the examples below.

Keeping the above considerations in mind, it has been found that particular processing parameters may improve the outcome of ECAE processes for aluminum alloys having magnesium, manganese, silicon, copper, and/or zinc. These parameters are outlined further in the examples below.

Process Parameters for ECAE

Pre-ECAE Heat Treatment

It has been discovered that producing stable Guinier Preston (GP) zones and establishing thermally stable precipitates in an aluminum alloy before performing ECAE may improve workability which, for example, may lead to reduced billet cracking during ECAE. In some embodiments, this is accomplished by performing heat treatment such as artificial aging before carrying out ECAE. In some embodiments, artificial aging incorporates a two-step heat treatment which limits the effects of unstable precipitation at room temperature (also referred to as natural aging). Controlling precipitation is important for ECAE processing of aluminum alloys having magnesium and zinc alloys because these alloys have a fairly unstable sequence of precipitation, and high deformation during ECAE makes the alloy even more unstable unless the processing conditions and order of heat treatment are carefully controlled.

The effects of heat and time on precipitation in an aluminum alloy having magnesium and zinc have been evaluated. The sequence of precipitation in an aluminum alloy having magnesium and zinc is complex and dependent on temperature and time. First, using high temperature heat treatment such as solutionizing, solutes such as magnesium and/or zinc are put in solution by distributing throughout the aluminum alloy. The high temperature heat treatment is often followed by rapid cooling in water or oil, also known as quenching, to hold the solutes in solution. At relatively low temperatures for long time periods and during initial periods of artificial aging at moderately elevated temperatures, the principal change is a redistribution of solute atoms within the solid solution lattice to form clusters termed Guinier Preston (GP) zones that are considerably enriched in solute. This local segregation of solute atoms produces a distortion of the alloy lattice. The strengthening effect of the zones is a result of the additional interference with the motion of dislocations when they cut the GP zones. The progressive strength increase with aging time at room temperature (defined as natural aging) has been attributed to an increase in the size of the GP zones.

In most systems as aging time or temperature are increased, the GP zones are either converted into or replaced by particles having a crystal structure distinct from that of the solid solution and also different from the structure of the equilibrium phase. Those are referred as "transition" precipitates. In many alloys, these precipitates have a specific crystallographic orientation relationship with the solid solution, such that the two phases remain coherent on certain planes by adaptation of the matrix through local elastic strain. Strength continues to increase as the size and number of these "transition" precipitates increase, as long as the dislocations continue to cut the precipitates. Further progress of the precipitation reaction produces growth of "transition" phase particles, with an accompanying increase in coherency strains until the strength of interfacial bond is exceeded and coherency disappears. This usually coincides with the change in the structure of the precipitate from "transition" to "equilibrium" form and corresponds to peak aging, which is the optimum condition to obtain maximum strength. With loss of coherency, strengthening effects are caused by the stress required to cause dislocations to loop around rather than to cut precipitates. Strength progressively decreases with growth of equilibrium phase particles and an increase in inter-particle spacing. This last phase corresponds to overaging and in some embodiments is not suitable when the main goal is to achieve maximum strength.

In an aluminum alloy having magnesium and zinc, the GP zones are very small in size (i.e. less than 10 nm) and quite unstable at room temperature. As shown in the examples provided herein, a high level of hardening occurs after the alloy has been held at room temperature for a few hours after quenching, a phenomenon called natural aging. One reason for this hardening in an aluminum alloy having magnesium and zinc is the fast diffusion rate of zinc, which is the element with the highest diffusion rate in aluminum. Another factor is the presence of magnesium which strongly influences the retention of a high concentration of non-equilibrium vacancies after quenching. magnesium has a large atomic diameter that makes the formation of magnesium-vacancy complexes and their retention during quenching easier. These vacancies are available for zinc to diffuse into and form GP zones around the magnesium atoms. Extended aging time and temperatures above room temperature (i.e. artificial aging) transform the GP zones into the transition precipitate called η' or M', the precursor of the equilibrium $MgZn_2$ phases termed η or M. For aluminum alloys having a higher magnesium content (e.g. greater than 2.0 wt. %), the precipitation sequence includes the GP zone transforming into a transition precipitate called T' that becomes the equilibrium $Mg_3Zn_3Al_2$ precipitate called T at extended aging time and temperature. The precipitation sequence in Al 7xxx can be summarized in the flow schematic shown in FIG. 6.

Figure 6:
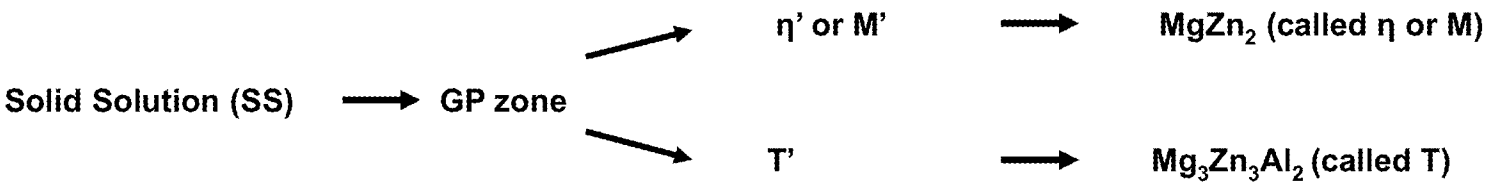
FIG. 6 is a schematic of a flow path of an example material change in an aluminum alloy undergoing heat treatment.

As shown in the flow schematic in FIG. 6, the GP zone nucleates homogeneously within the lattice and the various precipitates develop sequentially. However, the presence of grain boundaries, subgrain boundaries, dislocations and lattice distortions alters the free energy of zone and precipitate formation and significant heterogeneous nucleation may occur. This has two consequences in an aluminum alloy having magnesium and zinc. First, there is the potential for creating a non-homogeneous distribution of GP zones and precipitates, either of which may become a source for defects during cold or hot working. Second, heterogeneously nucleated precipitates at boundaries or dislocations are usually larger and do not contribute as much to the overall strength and therefore potentially decrease the maximum attainable strength. These effects may be enhanced when extreme levels of plastic deformation are introduced, for example during ECAE, directly after the solutionizing and quenching steps for at least the following reasons.

First, ECAE introduces a high level of subgrain, grain boundaries and dislocations that may enhance heterogeneous nucleation and precipitation and therefore lead to a non-homogenous distribution of precipitates. Second, GP zones or precipitates may decorate dislocations and inhibit their movement which leads to a reduction in local ductility. Third, even at room temperature processing, there is some level of adiabatic heating occurring during ECAE that provides energy for faster nucleation and precipitation. These interactions may happen dynamically during each ECAE pass. This leads to potentially detrimental consequences for the processing of a solutionized and quenched aluminum alloy having magnesium and zinc during ECAE.

Some of the potentially detrimental consequences are as follows. A propensity for surface cracking of the billet due to a loss in local ductility and heterogeneous precipitate distribution. This effect is most severe at the top billet surface. Limitation of the number of ECAE passes that can be used. As the number of passes increases the effects become more severe and cracking becomes more likely. A decrease in the maximum achievable strength during ECAE, partly due to heterogeneous nucleation effects and partly due to limitation of the number of ECAE passes, which affects the ultimate level of grain size refinement. An additional complication arises with the processing of solutionized and quenched aluminum-zinc alloys, such as Al 7xxx series alloys, due to the fast kinetics of precipitation even at room temperature (i.e. during natural aging). It has been found that the time between the solutionizing and quenching steps and ECAE may be important to control. In some embodiments, ECAE may be conducted relatively soon after the quenching step, for example, within one hour.

Stable precipitates may be defined as precipitates that are thermally stable in an aluminum alloy even when the aluminum alloy is at a temperature and time that is substantially close to artificial peak aging for its given composition. In particular, stable precipitates are precipitates that will not change during natural aging at room temperature. Note that these precipitates are not GP zones but instead include transition and/or equilibrium precipitates (e.g. 11' or M' or T' for aluminum-zinc alloys). The goal of heating (i.e. artificial aging) is to eliminate most of the unstable GP zones, which may lead to billet cracking during ECAE, and replace these with stable precipitates, which may be stable transition and equilibrium precipitates. It may also be suitable to avoid heating the aluminum alloy to conditions that are above peak aging (i.e. overaging conditions), which may produce mostly equilibrium precipitates that have grown and become too large, which may decrease the aluminum alloy final strength.

These limitations may be avoided by transforming most of the unstable GP zones into stable transition and/or equilibrium precipitates before performing the first ECAE pass. This may be accomplished, for example, by conducting a low temperature heat treatment (artificial aging) after or immediately after the solutionizing and quenching step, but before the ECAE process. In some embodiments, this may lead to most of the precipitation sequence occurring homogenously, contributing to a higher attainable strength and better stability of precipitates for ECAE processing. Furthermore, the heat treatment may consist of a two-step procedure that includes a first step that includes holding the material at a low temperature of 80° C. to 100° C. for less than or about 40 hours, and a second step that includes holding the material at a temperature and time that are less or equal than the peak aging conditions for the given an aluminum alloy having magnesium and zinc, for example holding the material between 100° C. and 150° C. for about 80 hours or less. The first low temperature heat treatment step provides a distribution of GP zones that is stable when the temperature is raised during the second heat treatment step. The second heat treatment step achieved the desired final distribution of stable transition and equilibrium precipitates.

In some embodiments, it may be advantageous to increase the uniformity and achieve a predetermined grain size of the alloy microstructure before conducting the final ECAE process at low temperature. In some embodiments, this may improve the mechanical properties and workability of the alloy material during ECAE as demonstrated by a reduced amount of cracking.

Aluminum alloys having magnesium and zinc are characterized by heterogeneous microstructures with large grain sizes and a large amount of macro and micro segregations. For example, the initial cast microstructure may have a dendritic structure with solute content increasing progressively from center to edge with an interdendritic distribution of second phase particles or eutectic phases. Certain homogenizing heat treatments may be performed before the solutionizing and quenching steps in order to improve structural uniformity and subsequent workability of billets. Cold working (such as stretching) or hot working is also often used to provide a specific billet shape or to stress relief or straighten the product. For plate applications such as forming a phone case, rolling may be used and may lead to anisotropy of the microstructure and properties in the final product even after heat treatments such as solutionizing, quenching and peak aging. Typically, grains are elongated along the rolling direction but are flattened along the thickness as well as the direction transverse to the rolling direction. This anisotropy is also reflected in the precipitate distribution, particularly along the grain boundaries.

In some embodiments, the microstructure of an aluminum alloy having magnesium and zinc with any temper, such as for example T651 may be broken down, refined, and made more uniform by applying a processing sequence that includes at least a single ECAE pass at elevated temperatures, such as below 450° C. This step is may be followed by solutionizing and quenching. In another embodiment, a billet made of the aluminum alloy having magnesium and zinc may be subjected to a first solutionizing and quenching step, followed by a single pass or multi-pass ECAE at moderately elevated temperatures between 150° C. and 250° C., followed by a second solutionizing and quenching step. After either of the above mentioned thermo-mechanical routes, the aluminum alloy can be further subjected to ECAE at a low temperature, either before or after artificial aging. In particular, it has been discovered that the initial ECAE process at elevated temperatures helps reduce cracking during a subsequent ECAE process at low temperatures of a solutionized and quenched aluminum alloy having magnesium and zinc. This result is described further in the examples below.

In some embodiments, ECAE may be used to impart severe plastic deformation and increase the strength of aluminum-zinc alloys. In some embodiments, ECAE may be performed after solutionizing, quenching and artificial aging is carried out. As described above, an initial ECAE process carried out while the material is at an elevated temperature may create a finer, more uniform and more isotropic initial microstructure before the second or final ECAE process at low temperature.

There are two main mechanisms for strengthening with ECAE. The first is refinement of structural units, such as the material cells, sub-grains and grains at the submicron or nanograined levels. This is also referred as grain size or Hall Petch strengthening and can be quantified using Equation 1.

$$\sigma_y = \sigma_0 + \frac{k_y}{\sqrt{d}} \qquad \text{Equation 1}$$

Where $\sigma_y$ is the yield stress, $\sigma_0$ is a material constant for the starting stress or dislocation movement (or the resistance of the lattice to dislocation motion), $k_y$ is the strengthening coefficient (a constant that is specific to each material), and d is the average grain diameter. Based on this equation, strengthening becomes particularly effective when d is less than 1 micron. The second mechanism for strengthening with ECAE is dislocation hardening, which is the multiplication of dislocations within the cells, subgrains, or grains of the material due to high straining during the ECAE process. These two strengthening mechanisms are activated by ECAE and it has been discovered that certain ECAE parameters can be controlled to produce particular final strengths in the aluminum alloy, particularly when extruding aluminum-zinc alloys that have previously been subjected to solutionizing and quenching.

First, the temperatures and time used for ECAE may be less than those corresponding to the conditions of peak aging for the given aluminum alloy having magnesium and zinc. This involves controlling both the die temperature during ECAE and potentially employing an intermediate heat treatment in between each ECAE pass, when an ECAE process including multiple passes is performed, to maintain the material being extruded at a desired temperature. For example, the material being extruded may be kept maintained at a temperature of about 200° C. for about 2 hours between each extrusion pass. In some embodiments, the material being extruded may be kept maintained at temperature of about 120° C. for about 2 hours in between each extrusion pass.

Second, in some embodiments, it may be advantageous to maintain the temperature of the material being extruded at as low a temperature as possible during ECAE to get the highest strength. For example, the material being extruded may be maintained at about room temperature. This may result in an increased number of dislocations formed and produce a more efficient grain refinement.

Third, it may be advantageous to perform multiple ECAE passes. For example, in some embodiments, two or more passes may be used during an ECAE process. In some embodiments, three or more, or four or more passes may be used. In some embodiments, a high number of ECAE passes provides a more uniform and refined microstructure with more equiaxed high angle boundaries and dislocations that result in superior strength and ductility of the extruded material.

In some embodiments, ECAE affects the grain refinement and precipitation in at least the following ways. In some embodiments, ECAE has been found to produce faster precipitation during extrusion, due to the increased volume of grain boundaries and higher mechanical energy stored in sub-micron ECAE processed materials. Additionally, diffusion processes associated with precipitate nucleation and growth are enhanced. This means that some of the remaining GP zones or transition precipitates can be transformed dynamically into equilibrium precipitates during ECAE. In some embodiments, ECAE has been found to produce more uniform and finer precipitates. For example, a more uniform distribution of very fine precipitates can be achieved in ECAE submicron structures because of the high angle boundaries. Precipitates can contribute to the final strength of the aluminum alloy by decorating and pinning dislocations and grain boundaries. Finer and more uniform precipitates may lead to an overall increase in the extruded aluminum alloy final strength.

There are additional parameters of the ECAE process that may be controlled to further increase success. For example, the extrusion speed may be controlled to avoid forming cracks in the material being extruded. Second, suitable die designs and billet shapes can also assist in reducing crack formation in the material.

In some embodiments, additional rolling and/or forging may be used after the aluminum alloy has undergone ECAE to get the aluminum alloy closer to the final billet shape before machining the aluminum alloy into its final production shape. In some embodiments, the additional rolling or forging steps can add further strength by introducing more dislocations in the micro-structure of the alloy material.

In the examples described below, Brinell hardness was used as an initial test to evaluate the mechanical properties of aluminum alloys. For the examples included below, a Brinell hardness tester (available from Instron®, located in Norwood, Mass.) was used. The tester applies a predetermined load (500 kgf) to a carbide ball of fixed diameter (10 mm), which is held for a predetermined period of time (10-15 seconds) per procedure, as described in ASTM standard. Measuring Brinell hardness is a relatively straightforward testing method and is faster than tensile testing. It can be used to form an initial evaluation for identifying suitable materials that can then be separated for further testing. The hardness of a material is its resistance to surface indentation under standard test conditions. It is a measure of the material's resistance to localized plastic deformation. Pressing a hardness indentor into the material involves plastic deformation (movement) of the material at the location where the indentor is impressed. The plastic deformation of the material is a result of the amount of force applied to the indentor exceeding the strength of the material being tested. Therefore, the less the material is plastically deformed under the hardness test indentor, the higher the strength of the material. At the same time, less plastic deformation results in a shallower hardness impression; so the resultant hardness number is higher. This provides an overall relationship, where the higher a material's hardness, the higher the expected strength. That is, both hardness and yield strength are indicators of a metal's resistance to plastic deformation. Consequently, they are roughly proportional.

Tensile strength is usually characterized by two parameters: yield strength (YS) and ultimate tensile strength (UTS). Ultimate tensile strength is the maximum measured strength during a tensile test and it occurs at a well-defined point. Yield strength is the amount of stress at which plastic deformation becomes noticeable and significant under tensile testing. Because there is usually no definite point on an engineering stress-strain curve where elastic strain ends and plastic strain begins, the yield strength is chosen to be that strength where a definite amount of plastic strain has occurred. For general engineering structural design, the yield strength is chosen when 0.2% plastic strain has taken place. The 0.2% yield strength or the 0.2% offset yield strength is calculated at 0.2% offset from the original cross-sectional area of the sample. The equation that may be used is $s=P/A$, where s is the yield stress or yield strength, P is the load and A is the area over which the load is applied.

Figure 7:
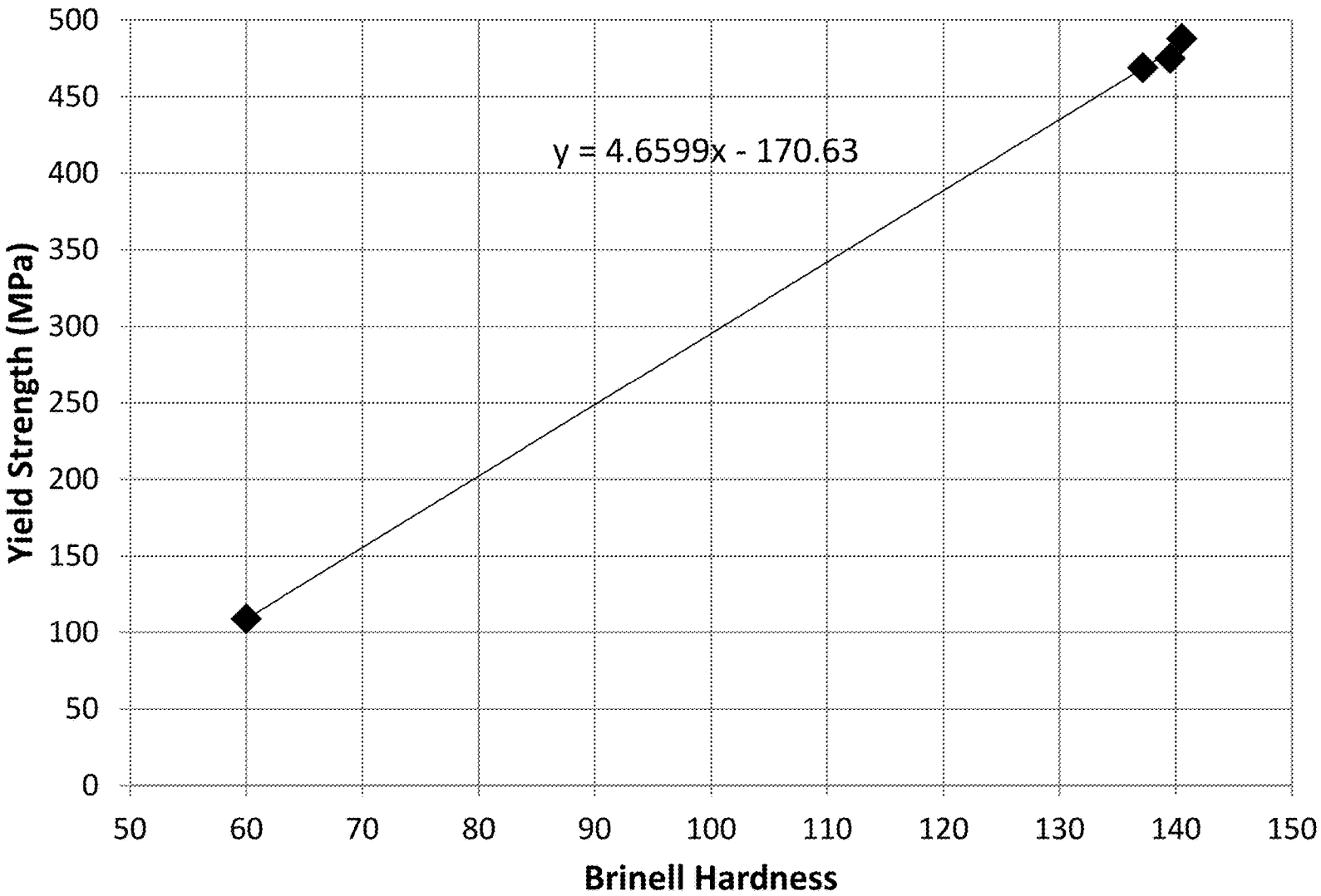
FIG. 7 is a graph comparing Brinell hardness to yield strength in an aluminum alloy.

Note that yield strength is more sensitive than ultimate tensile strength due to other microstructural factors such as grain and phase size and distribution. However, it is possible to measure and empirically chart the relationship between yield strength and Brinell hardness for specific materials, and then use the resulting chart to provide an initial evaluation of the results of a method. Such a relationship was evaluated for the materials and examples below. The data was graphed and the results are shown in FIG. 7. As shown in FIG. 7, it was determined that for the materials evaluated, a Brinell hardness above about 111 HB corresponds to YS above 350 MPa and a Brinell hardness above about 122 HB corresponds to YS above 400 MPa.

EXAMPLES

The following non-limiting examples illustrate various features and characteristics of the present invention, which is not to be construed as limited thereto.

Example 1: Natural Aging in an Aluminum Alloy Having Magnesium and Zinc

The effect of natural aging was evaluated in an aluminum alloy having aluminum as a primary component and magnesium and zinc as secondary components. For this initial assay, Al 7020 was chosen because of its low Cu weight percentage and the zinc to magnesium ratio from about 3:1 to 4:1. As discussed above, these factors affect the cosmetic appearance for applications such as device casings. The composition of the sample alloy is displayed in Table 1 with a balance of aluminum. It should be noted that zinc (at 4.8 wt. %) and magnesium (at 1.3 wt. %) are the two alloying elements present in the highest concentrations and the Cu content is low (at 0.13 wt. %).

TABLE 1

Composition of Al 7020 Starting Material (Weight Percentage)

| Si | Fe | Cu | Mn | Mg | Cr | Zn | Zr | Ti + Zr | Ag |
|---|---|---|---|---|---|---|---|---|---|
| 0.1 | 0.28 | 0.13 | 0.25 | 1.3 | 0.12 | 4.8 | 0.13 | 0.16 | 0 |

Figure 8:
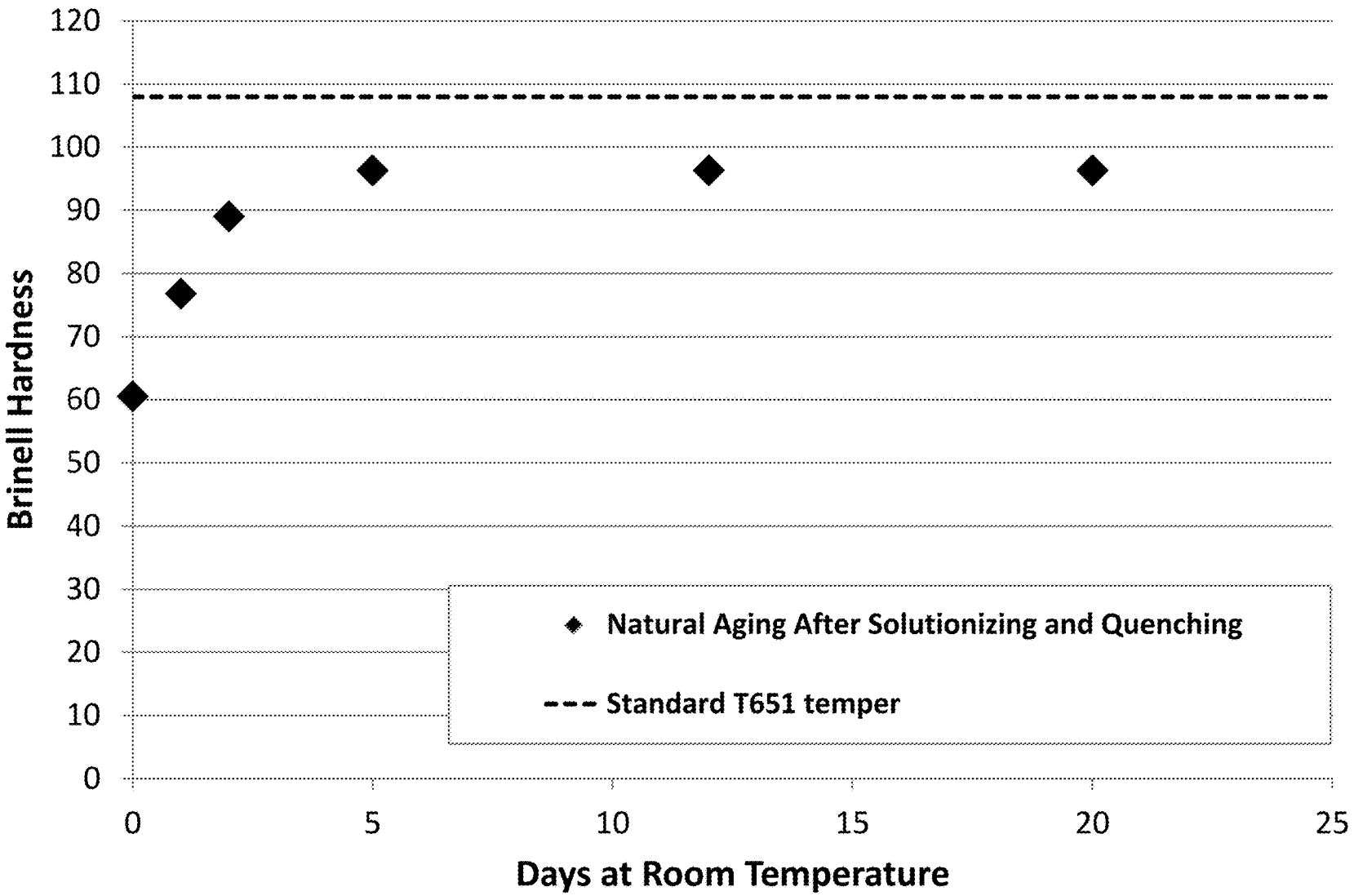
FIG. 8 is a graph comparing natural aging time to Brinell hardness in an aluminum alloy.

The as-received Al 7020 material was subjected to a solutionizing heat treatment by holding the material at 450° C. for two hours and then was quenched in cold water. The sample material was then kept at room temperature (25° C.) for several days. The Brinell hardness was used to evaluate the stability of the mechanical properties of the sample material after being stored at room temperature for a number of days (so called natural aging). The hardness data is presented in FIG. 8. As shown in FIG. 8, after only one day at room temperature there was already a substantial increase in hardness from 60.5 HB to about 76.8 HB; about a 30% increase. After about 5 days at room temperature, the hardness reached 96.3 HB and remained fairly stable, showing minimal changes when measured over 20 days. The rate of increase in hardness indicates an unstable supersaturated solution and precipitation sequence for Al 7020. This unstable supersaturated solution and precipitation sequence is characteristic of many Al 7xxx series alloys.

Example 2: Example of Anisotropy of Microstructure in the Initial Alloy Material The aluminum alloy formed in Example 1 was subjected to hot rolling to form the alloy material into a billet followed by thermo-mechanical processing to the T651 temper that includes solutionizing, quenching, stress relief by stretching to an increase of 2.2% greater than the starting length and artificial peak aging. The measured mechanical properties of the resulting material are listed in Table 2. The yield strength, ultimate tensile strength and Brinell hardness of the Al 7020 material are 347.8 MPa, 396.5 MPa and 108 HB respectively. The tensile testing was conducted with the example material at room temperature using round tension bars with threaded ends. The diameter of the tension bars were 0.250 inch and the gage was length 1.000 inch. The geometry of round tension test specimens is described in ASTM Standard E8.

TABLE 2

Mechanical Properties of Al 7020 Material in Example 2

| Temper | YS (MPa) | UTS (MPa) | Percent Elongation (%) | Hardness (HB) |
|---|---|---|---|---|
| T651 | 347.8 | 396.5 | 14.4 | 108 |

Figure 9:
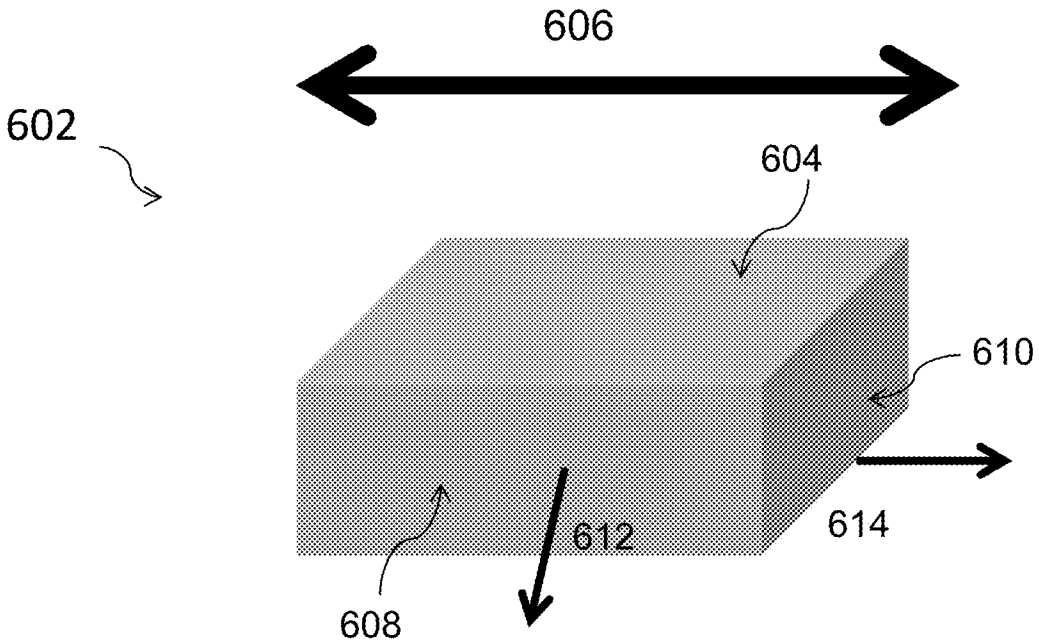
FIG. 9 is a schematic illustrated various orientations of a sample material prepared for thermomechanical processing.
Figure 10A:
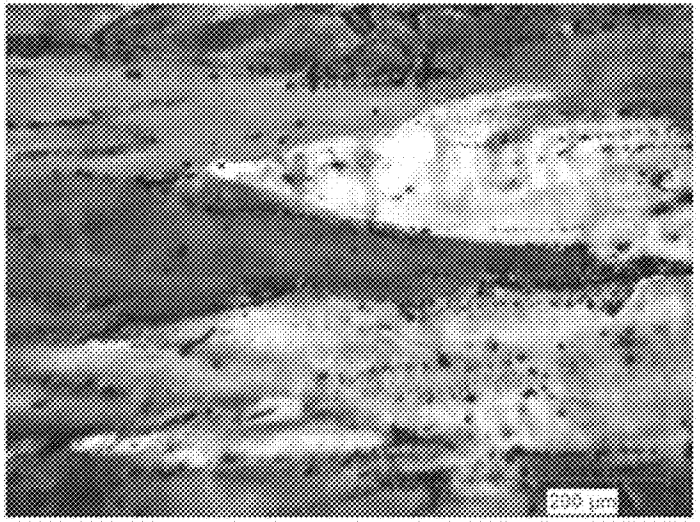
FIGS. 10A to 10C are optical microscopy images of an aluminum alloy that has been processed using exemplary methods disclosed herein.
Figure 10B:
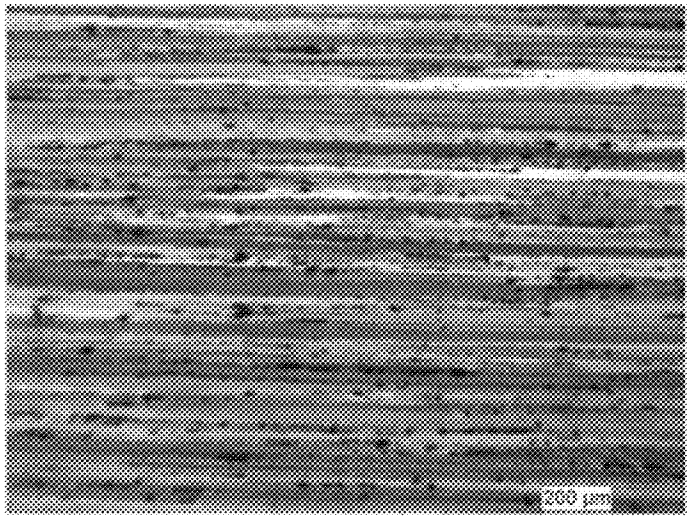
Figure 10C:
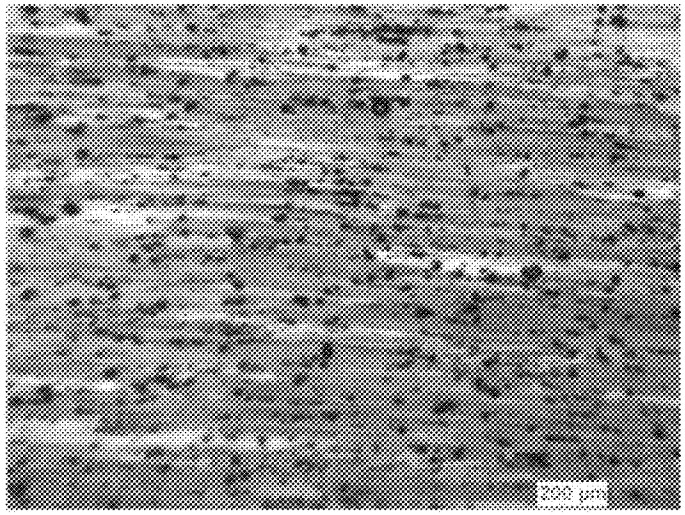

FIG. 9 illustrates the planes of an example billet 602 to show the orientation of a top face 604 of the billet 602. The arrow 606 shows the direction of rolling and stretching. The first side face 608 is in the plane parallel to the rolling direction and perpendicular to the top face 604. The second side face 610 is in the plane perpendicular to the rolling direction of arrow 606 and the top face 604. Arrow 612 shows the direction normal to the plane of the first side face, and arrow 614 shows the direction normal to the plane of the second side face 610. An optical microscopy image of the grain structure of the Al 7020 material from Example 2 is shown in FIGS. 10A to 10C. FIGS. 10A to 10C show the microstructure of Al 7020 with a T651 temper across the three planes shown in FIG. 9. Optical microscopy was used for grain size analysis. FIG. 10A is an optical microscopy image of the top face 604 shown in FIG. 9 at ×100 magnification. FIG. 10B is an optical microscopy image of the first side face 608 shown in FIG. 9 at ×100 magnification. FIG. 10C is an optical microscopy image of the second side face 610 shown in FIG. 9 at ×100 magnification.

As shown in FIGS. 10A to 10C, an anisotropic fibrous microstructure consisting of elongated grains is detected. The original grains are compressed through the billet thickness, which is the direction normal to the rolling direction, and elongated along the rolling direction during thermo-mechanical processing. The grain sizes as measured across the top face are large and non-uniform around 400 to 600 μm in diameter with a large aspect ratio of average grain length to thickness ranging between 7:1 to 10:1. The grain boundaries are difficult to resolve along the two other faces shown in FIGS. 10B and 10C, but clearly demonstrate heavy elongation and compression as exemplified by thin parallel bands. This type of large and non-uniform microstructure is characteristic in aluminum alloys having magnesium and zinc and having a standard temper such as T651.

Example 3: ECAE of as Solutionized and Quenched Al 7020 Material

A billet of Al 7020 material with the same composition and T651 temper as in Example 2 was subjected to solutionizing at a temperature of 450° C. for 2 hours and immediately quenched in cold water. This process was carried out to retain the maximum number of elements added as solutes, such as zinc and magnesium, in solid solution in the aluminum material matrix. It is believed that this step also dissolved the (ZnMg) precipitates present in the aluminum material back into the solid solution. The resulting microstructure of the Al 7020 material was very similar to the one described in Example 2 for aluminum material that had the temper T651, and consisted of large elongated grains parallel to the initial rolling direction. The only difference is the absence of fine soluble precipitates. The soluble precipitates are not visible by optical microscopy because they are below the resolution limit of 1 micron; only the large (i.e. greater than 1 micron in diameter) non soluble precipitates are visible. Thus, the results of Example 3 illustrate that the after solutionizing and quenching steps the grain size and anisotropy of the initial T651 microstructure remained unchanged.

Figure 11:
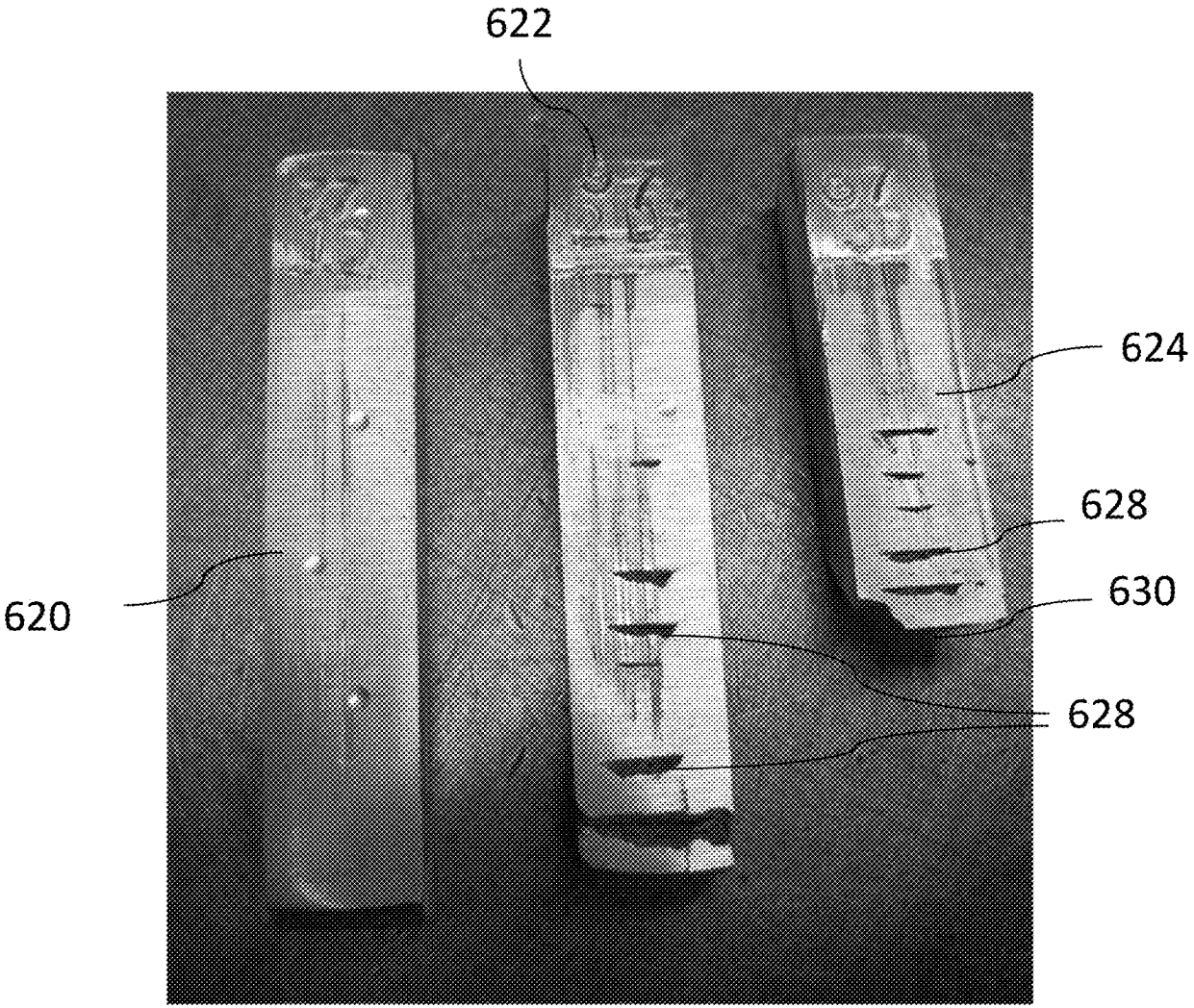
FIG. 11 is an image of an aluminum alloy that has been processed using exemplary methods disclosed herein.

The Al 7020 material was then shaped into three billets, i.e. bars, with a square cross-section and a length that is greater than the cross-section, and ECAE was then performed on the billets. The first pass was performed within 30 minutes after the solutionizing and quenching to minimize the effect of natural aging. Furthermore, ECAE was conducted at room temperature to limit the temperature effects on precipitation. FIG. 11 shows a photograph of a first billet 620 of Al 7020 after having undergone one pass, a second billet 622 having undergone two passes, and a third billet 624 having undergone three passes. The ECAE process was successful for the first billet 620 after one pass. That is, as shown in FIG. 11, the billet did not crack after one ECAE pass. However, heavy localized cracking at the top face of the billet occurred in the second billet 622 that was subjected to two passes. FIG. 11 shows the cracks 628 in the second billet 622 that developed after two passes. As also shown in FIG. 11, the third billet 624, which was subjected to three passes, also exhibited cracks 628. As shown in FIG. 11, the cracks intensified to such an extent that one macro-crack 630 ran through the entire thickness of the third billet 624 and split the billet into two pieces.

The three sample billets were further submitted to a two-step peak aging treatment consisting of a first heat treatment step with the samples held at 90° C. for 8 hours followed by a second heat treatment step with the samples held at 115° C. for 40 hours. Table 3 displays Brinell hardness data as well as tensile data for the first billet 620. The second billet 622 and the third billet 624 had too deep of cracking and the machine tensile test could not be conducted for these samples. All measurements were conducted with the sample material at room temperature.

TABLE 3

Test Results After Various Numbers of ECAE Passes and aging treatment

| Sample | Number of ECAE passes | Brinell Hardness (HB) | YS (MPa) | UTS (MPa) | Surface condition |
|---|---|---|---|---|---|
| Billet 620 | 1 | 127 | 382 | 404 | good |
| Billet 622 | 2 | 132 | n/a | n/a | crack at top |
| Billet 624 | 3 | 138 | n/a | n/a | crack through sample |

As shown in Table 3, a steady increase in hardness from about 127 to 138 was recorded with an increasing number of ECAE passes. The material hardness after each pass was higher than the hardness value for material having only the T651 temper condition, as shown in Example 2. Yield strength data for the first sample after one pass also showed an increase in yield strength when compared to material having only the T651 temper. For example, the yield strength increased from 347.8 MPa to 382 MPa.

This example demonstrated the ability of ECAE to improve strength in aluminum-zinc alloys as well as certain limitations due to billet cracking during ECAE processing. The next examples illustrate techniques that can be used to improve the overall processing when applying ECAE to Al alloys at low temperatures and, can increase the Al alloy material strength without cracking the material.

Example 4: Multi-Step ECAE of As-Solutionized and Quenched Samples—Effect of Initial Grain Size and Anisotropy To evaluate the potential effect of the initial microstructure on the processing results, Al7020 material with the T651 temper of Examples 1 and 2 was submitted to a more complex thermo-mechanical processing route than in Example 3. In this Example, ECAE was performed in two steps, one before and one after a solutionizing and quenching step with each step including an ECAE cycle having multiple passes. The first ECAE cycle was aimed at refining and homogenizing the microstructure before and after the solutionizing and quenching step, whereas the second ECAE cycle was conducted at a low temperature to improve the final strength as in Example 3.

The following process parameters were used for the first ECAE cycle. Four ECAE passes were used, with a 90 degree rotation of the billet between each pass to improve the uniformity of deformation and as a result the uniformity of microstructure. This is accomplished by activating simple shear along a three dimensional network of active shear planes during multi-pass ECAE. The Al 7020 material that formed the billet was maintained at a processing temperature of 175° C. throughout the ECAE. This temperature was chosen because it is low enough to give submicron grains after ECAE, but is above the peak aging temperature and therefore provides an overall lower strength and higher ductility, which is favorable for the ECAE process. The Al 7020 material billets did not suffer any cracking during this first ECAE cycle.

Figure 12B:
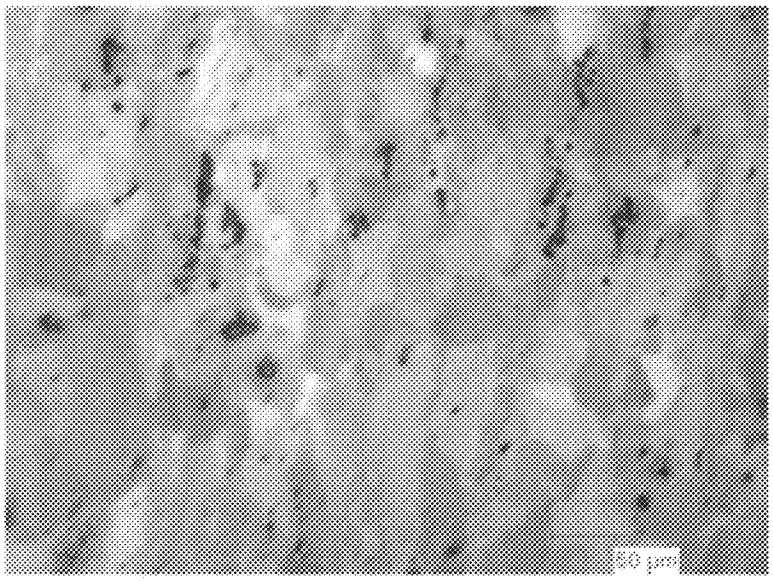
FIGS. 12A and 12B are optical microscopy images of an aluminum alloy that has been processed using exemplary methods disclosed herein.
Figure 12A:
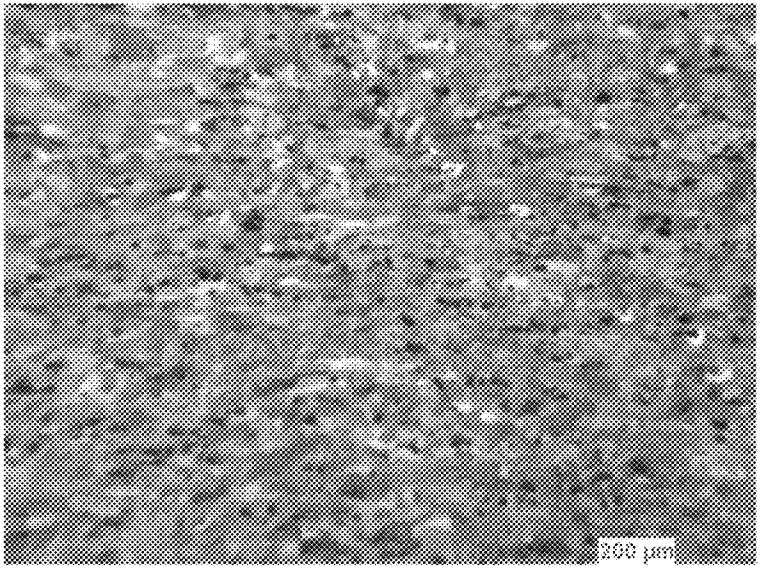

After the first ECAE process, solutionizing and quenching was carried out using the same conditions as described in Example 3 (i.e. the billet was held at 450° C. for 2 hours followed by immediate quenching in cold water). The microstructure of the resulting Al 7020 material was analyzed by optical microscopy and is shown in FIGS. 12A and 12B. FIG. 12A is the resulting material at ×100 magnification and FIG. 12B is the same material at ×400 magnification. As shown in FIGS. 12A and 12B, the resulting material consists of fine isotropic grain sizes of 10-15 μm throughout the material in all directions. This microstructure was formed during the high temperature solution heat treatment by recrystallization and growth of the submicron grains that were initially formed by the ECAE. As shown in FIGS. 12A and 12B, the resulting material contains grains that are much finer and the material possesses a better isotropy in all directions than the solutionized and quenched initial microstructure of Example 3.

After the solutionizing and quenching, the samples were again deformed via another process of ECAE, this time at a lower temperature than used in the first ECAE process. For comparison, the same process parameters used in Example 3 were used in this second ECAE process. The second ECAE process was performed at room temperature with two passes as soon as possible after the quench step (i.e. within 30 minutes of quenching). The overall ECAE processing was discovered to have improved results using the second ECAE process as the lower temperature ECAE process. In particular, unlike in Example 3, the billet in Example 4 did not crack after two ECAE passes conducted with the billet material at lower temperature. Table 4 shows tensile data collected after the sample material had been subjected to two ECAE passes.

TABLE 4

Results of Al 7020 Material After Two ECAE Cycles, With Second ECAE Cycle Having Two Passes

| Number of ECAE passes | Brinell Hardness (HB) | YS (MPa) | UTS (MPa) | Surface condition |
|---|---|---|---|---|
| 2 | 133 | 416 | 440 | good |

As shown in Table 4, the resulting material also had a substantial improvement over material that has only had a T651 temper condition. That is, the Al 7020 material that underwent the two step ECAE process had a yield strength of 416 MPa and an ultimate tensile strength of 440 MPa.

Example 4 demonstrates that the grain size and isotropy of the material before ECAE can affect the processing results and ultimate attainable strength. ECAE at relatively moderate temperatures (around 175° C.) may be an effective method to break, refine and uniformize the structure of Al 7xxx alloy material and make the material better for further processing. Other important factors for processing Al 7xxx with ECAE are the stabilization of GP zone and precipitates prior to ECAE processing. This is described further in the following examples.

Example 5: ECAE of Artificially Aged Al 7020 Samples Having Only T651 Temper

In this Example, the Al 7020 alloy material of Example 1 was submitted to an initial processing that included solutionizing, quenching, stress relief by stretching to 2.2% greater than the starting length, and artificial peak aging. Artificial peak aging of this Al 7020 material consisted of a two-step procedure that included a first heat treatment at 90° C. for 8 hours followed by a second heat treatment at 115° C. for 40 hours, which is similar to a T651 temper for this material. Peak aging was started within a few hours after the quenching step. The Brinell hardness of the resulting material was measured at 108 HB and the yield strength was 347 MPa (i.e. similar to the material in Example 2). The first heat treatment step is used to stabilize the distribution of GP zones before the second heat treatment and to inhibit the influence of natural aging. This procedure was found to encourage homogeneous precipitation and optimize strengthening from precipitation.

Low temperature ECAE was then conducted after the artificial peak aging. Two ECAE process parameters were evaluated. First, the number of ECAE passes was varied. One, two, three, and four passes were tested. For all ECAE cycles, the material billets were rotated by 90 degrees between each pass. Second, the effect of material temperature during ECAE was varied. The ECAE die and billet temperatures evaluated were 25° C., 110° C., 130° C., 150° C., 175° C., 200° C., and 250° C. Both Brinell hardness and tensile data were taken with the sample material at room temperature after certain processing conditions in order to evaluate the effects on strengthening. Optical microscopy was used to create images of samples of the resulting material and is shown in FIGS. 13A and 13B.

As an initial observation, no cracking was observed in the material of any of the sample billets, even for billets that underwent ECAE processing at room temperature. This example contrasts with Example 3, where ECAE was conducted right after the unstable solutionized and quenched state and cracking occurred in the second and third samples. This result shows the effect of the stabilization of GP zones and precipitates on the processing of Al 7xxx series alloy material. This phenomenon is specific to Al 7xxx alloys due to the nature and fast diffusion of the two main constitutive elements, zinc and magnesium.

Figure 13B:
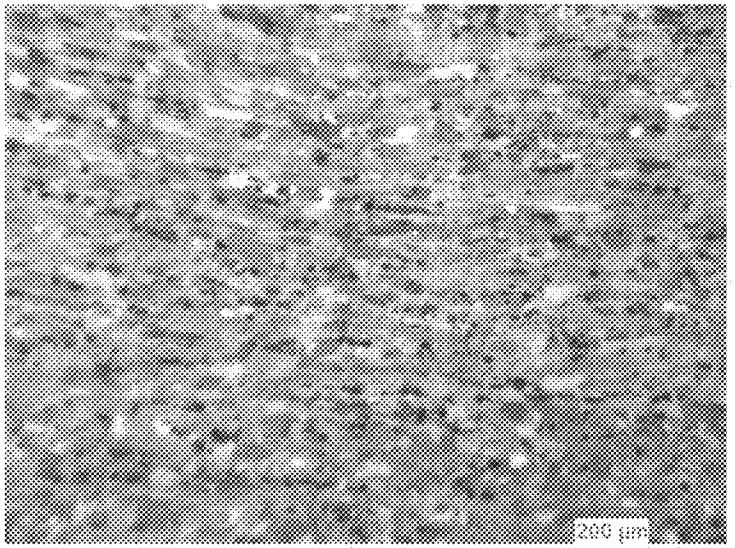
FIGS. 13A and 13B are optical microscopy images of an aluminum alloy that has been processed using exemplary methods disclosed herein.
Figure 13A:
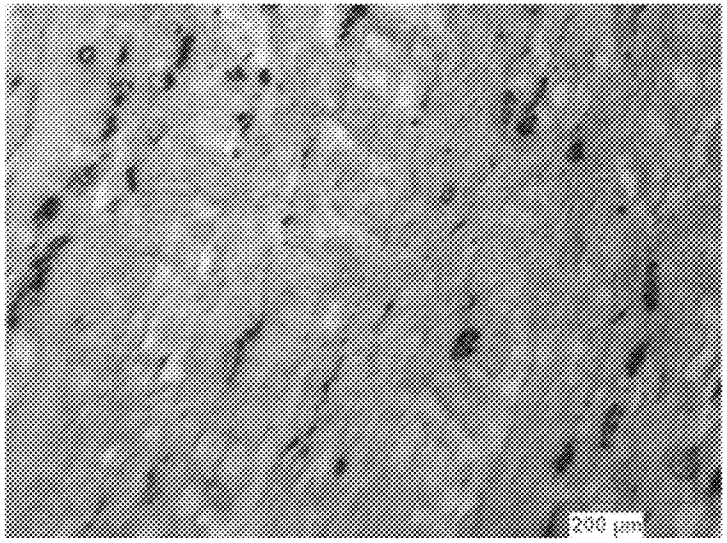

FIGS. 13A and 13B show typical microstructures of the Al 7020 alloy material after undergoing ECAE as analyzed by optical microscopy. FIG. 13A shows the material at room temperature after being subjected to four ECAE passes at room temperature and after being held at about 250° C. for one hour. FIG. 13B shows the material at room temperature after being subjected to four ECAE passes at room temperature and after being held at 325° C. for one hour. From these images, it was discovered that the submicron grain size was stable up to about 250° C. After being held at about 250° C. for one hour, the average measured grain size was submicron (less than 1 μm in diameter). The measured average grain size was from about 0.1 μm to about 0.8 μm in diameter. After being held at about 300° C. to about 325° C. for the same amount of time, full recrystallization occurred and the submicron grain size grew into a uniform and fine recrystallized microstructure with grain sizes of about 5-10 μm. The grain size increased slightly, up to about 10-15 μm, after heat treatment at temperatures as of about 450° C., which is in the typical temperature range for solutionizing (see Example 4). This structural study shows that hardening due to grain size refinement by ECAE can be most effective when ECAE is performed at temperatures below about 250° C. to 275° C., i.e. when the grain size is submicron.

Table 5 contains the measured results of Brinnell hardness and tensile strength as a result of varying the temperature of the Al 7020 alloy material during ECAE.

TABLE 5

Effect of Al 7020 Material Temperature During ECAE on Final Yield Strength

| Process | YS (MPa) | UTS (MPa) | YS % increase | UTS % increase |
|---|---|---|---|---|
| T651 temper | 347.8 | 396.5 | | |
| 4 ECAE passat 125° C. | 417 | 474 | 19.9 | 19.5 |
| 4 ECAE passat 100° C. | 447 | 483 | 28.5 | 21.8 |
| 4 ECAE pass at 25° C. | 488 | 493 | 40.3 | 24.3 |

Figure 14:
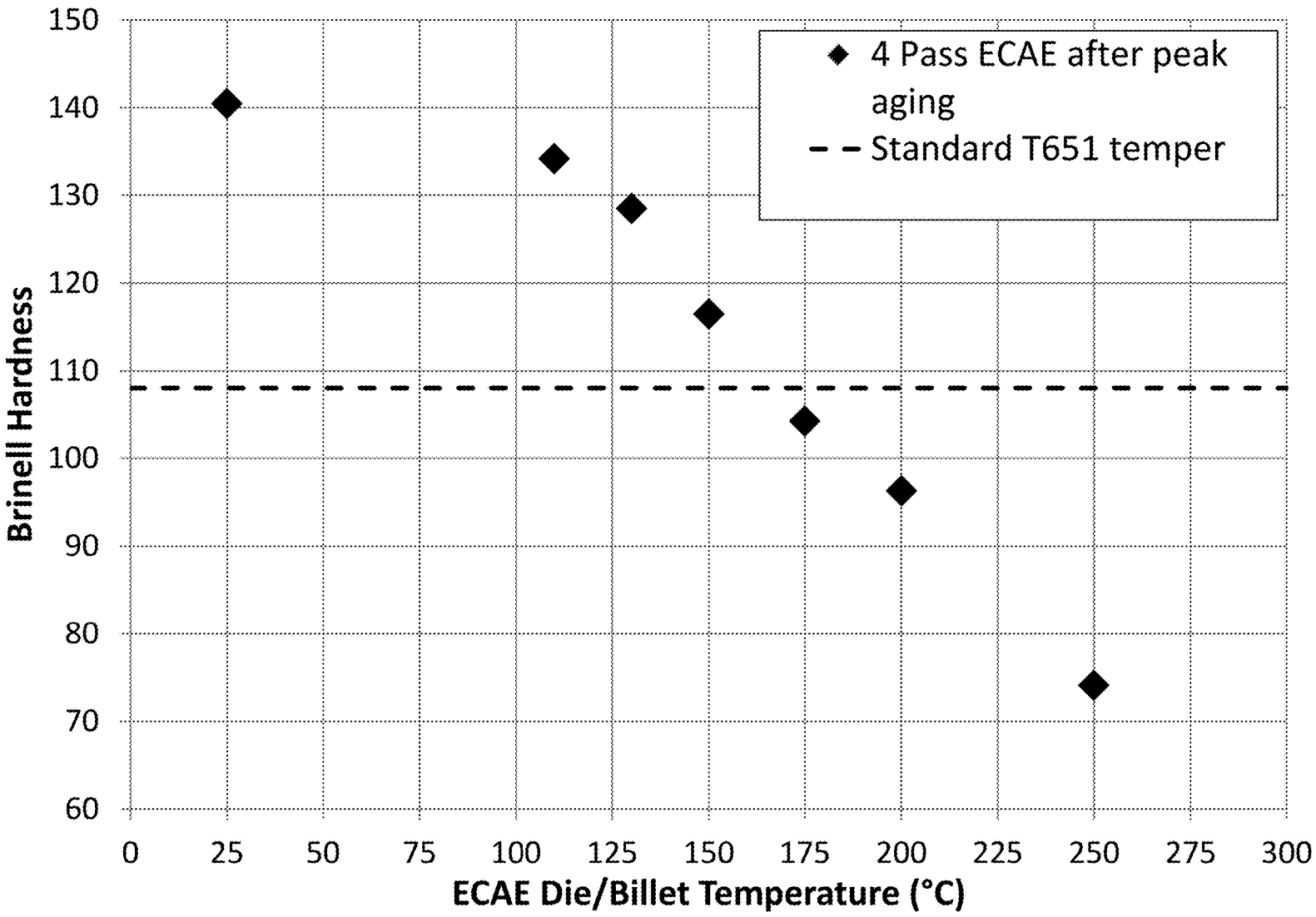
FIG. 14 is a graph comparing material temperature to Brinell hardness in an aluminum alloy processed using exemplary methods disclosed herein.
Figure 15:
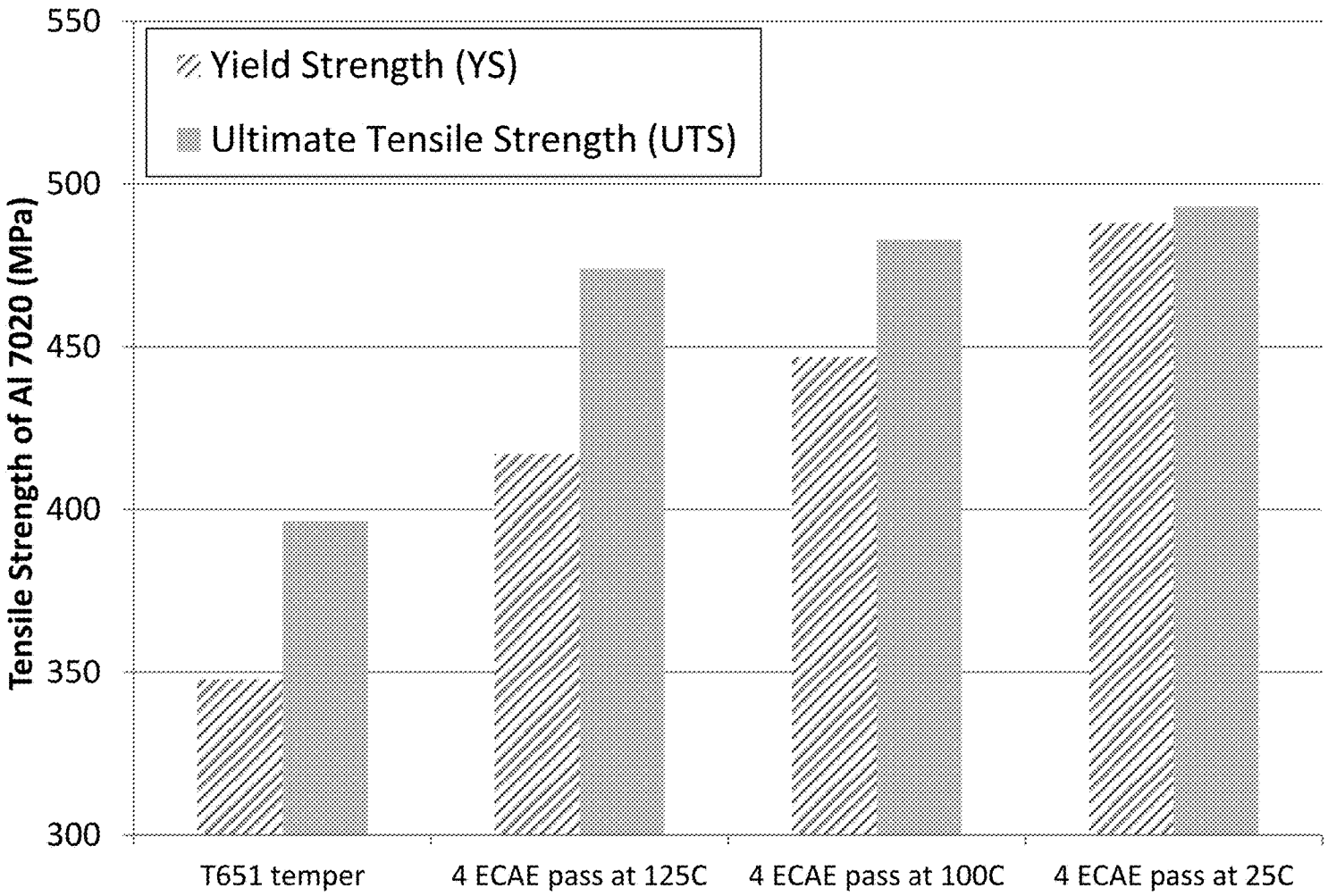
FIG. 15 is a graph comparing processing temperature to tensile strength in an aluminum alloy processed using exemplary methods disclosed herein.

FIGS. 14 and 15 show the measured results of the material formed in Example 5 as graphs showing the effect of ECAE temperature on the final Brinell hardness and tensile strength. All samples shown in FIGS. 14 and 15 were subjected to a total of 4 ECAE passes with intermediate annealing at a given temperature for short periods lasting between 30 minutes and one hour. As shown in FIG. 14, hardness was greater than material having only the T651 temper when the material underwent ECAE while the material temperature during extrusion was less or equal to about 150° C. Furthermore, strength and hardness was higher as the billet material processing temperature was reduced, with the greatest increase shown from 150° C. to about 110° C. The sample that had the greatest final strength was the sample that underwent ECAE with the billet material at room temperature. As shown in FIG. 15 and Table 5, this sample had a resulting Brinell hardness around 140 HB and YS and UTS equal to 488 MPa and 493 MPa respectively. This shows a nearly 40% increase in yield strength above material having only a standard T651 temper. Even at 110° C., which is near the peak aging temperature for this material, YS and UTS are respectively 447 MPa and 483 MPa. Some of these results can be explained as follows.

Holding the Al 7020 alloy material at temperatures from about 115° C. to 150° C. for a few hours corresponds to an overaging treatment in Al 7xxx alloys when precipitates have grown larger than during conditions of peak aging, which gives peak strength. At temperatures of about 115° C. to about 150° C., the ECAE extruded material is still stronger than material having only undergone the T651 temper because the strength loss due to overaging is compensated by grain size hardening due to ECAE. The strength loss due to overaging is rapid, which explains the lowered final strength when the material is held at temperatures increasing from 110° C. to about 150° C., as shown in FIG. 14. Above about 200° C. to about 225° C., strength loss is not only caused by overaging but also by the growth of the submicron grain size. The effect is also observed at temperatures above 250° C. where recrystallization starts to occur.

Temperatures around 110° C. to about 115° C. are near the conditions for peak aging of Al 7xxx (i.e. the T651 temper) and the increased strength above the strength of material having only a T651 temper is due mainly to grain size and dislocation hardening by ECAE. When the Al 7020 alloy material is at temperatures below about 110° C. to about 115° C., precipitates are stable and in the peak aged condition. As the material is lowered to temperatures near room temperature, ECAE hardening becomes more effective because more dislocations and finer submicron grain sizes are created. The rate of strength increase when the material is processed around room temperature is more gradual compared to temperatures between about 110° C. and 150° C.

Figure 16:
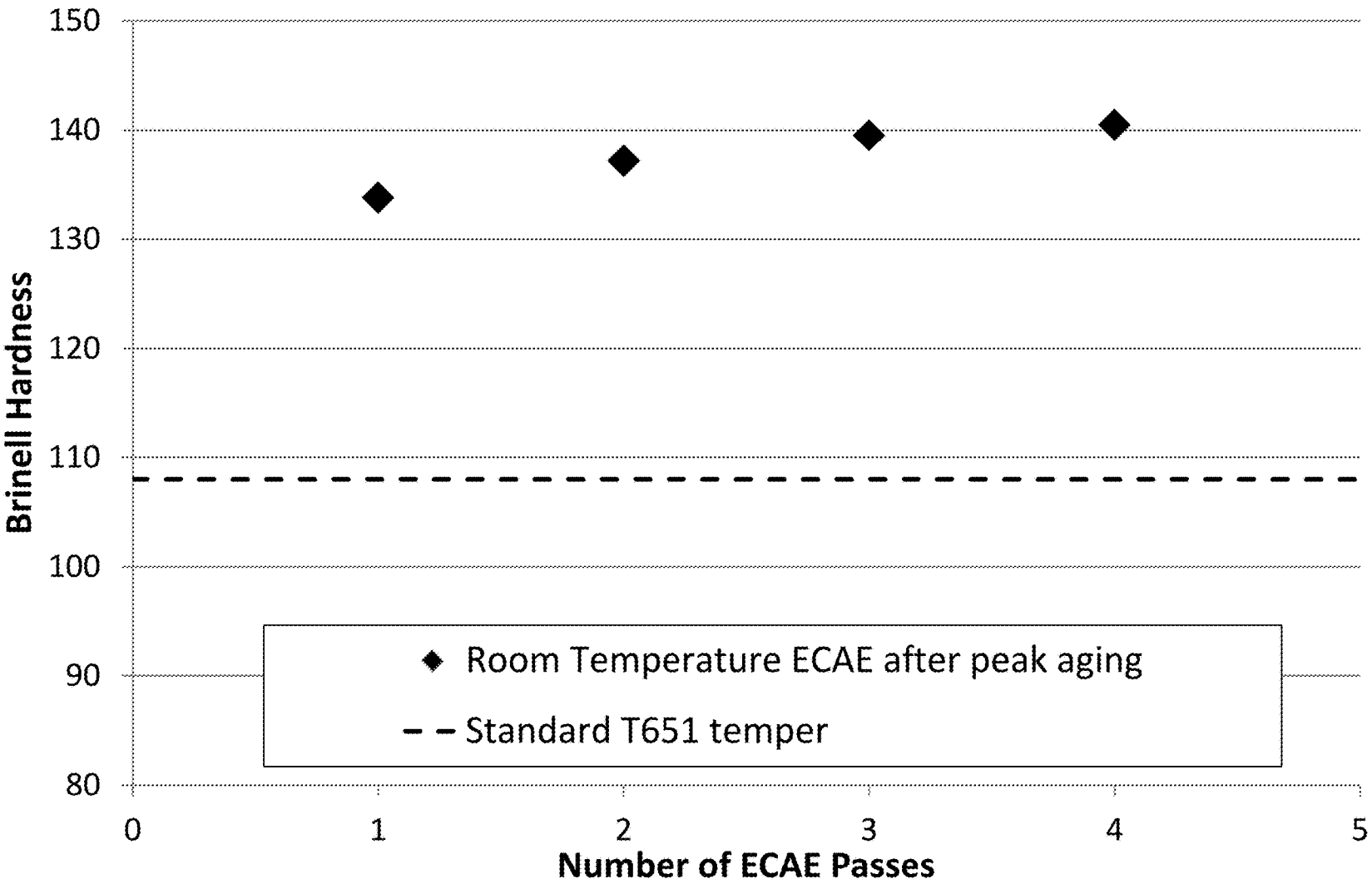
FIG. 16 is a graph comparing the number of extrusion passes to the resulting Brinell hardness of an aluminum alloy processed using exemplary methods disclosed herein.
Figure 17:
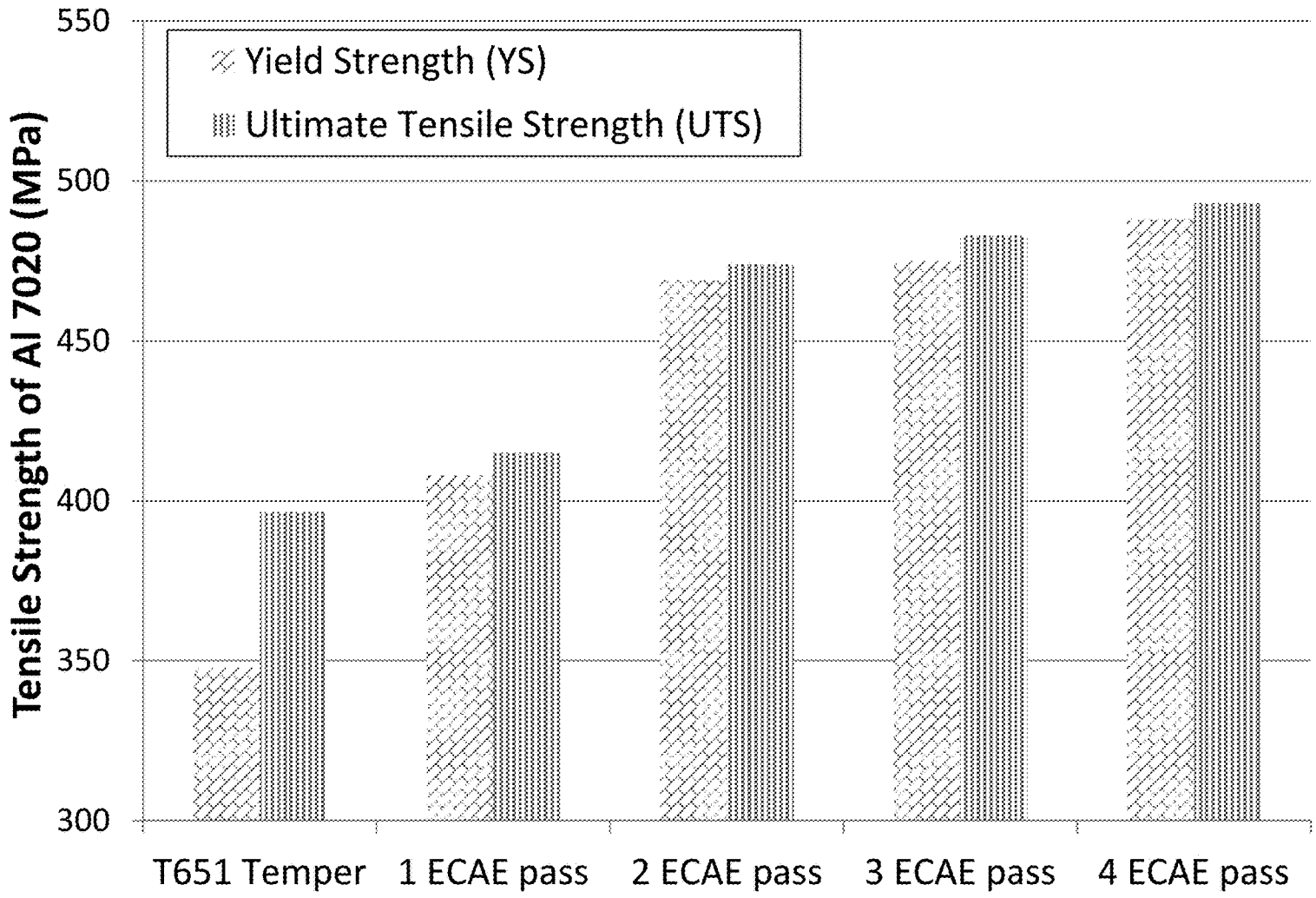
FIG. 17 is a graph comparing the number of extrusion passes to the resulting tensile strength of an aluminum alloy processed using exemplary methods disclosed herein.

FIGS. 16 and 17 and Table 6 show the effect of the number of ECAE passes on the attainable strength of the Al 7020 alloy.

TABLE 6

Effect of Number of ECAE Passes on Al 7020 Material Final Yield Strength

| Process | YS (MPa) | UTS (MPa) | YS % increase | UTS % increase |
|---|---|---|---|---|
| T651 Temper | 347.8 | 396.5 | | |
| 1 ECAE pass | 408 | 415 | 17.3% | 4.7% |
| 2 ECAE passes | 469 | 474 | 34.8% | 19.5% |
| 3 ECAE passes | 475 | 483 | 36.6% | 21.8% |
| 4 ECAE passes | 488 | 493 | 40.3% | 24.3% |

The samples used to create the data in the graphs of FIGS. 16 and 17 were extruded with the sample material at room temperature and the billet was rotated by 90 degrees between each pass. A gradual increase in strength and hardness was observed with an increasing number of ECAE passes. The largest increase in strength and hardness occurred after the material had undergone between one and two passes. In all cases, the final yield strength was over 400 MPa, specifically 408 MPa, 469 MPa, 475 MPa and 488 MPa after one, two, three and four passes respectively. This example shows that the mechanisms of refinement into submicron grain size that include dislocation generation and interaction and creation of new grain boundaries become more effective with increasing levels of deformation by simple shear during ECAE. A lower billet material temperature during ECAE can also lead to increased strengths as described earlier.

As shown in Example 5, improvements in strength were achieved without cracking the material by performing ECAE after artificial aging that used a two-step aging procedure to stabilize GP zones and precipitates. Avoiding cracking of the billet enables a lower ECAE processing temperature and allows for a higher number of ECAE passes to be used. As a consequence, higher strengths can be formed in the Al 7020 alloy material.

Example 6: Comparison of Various Processing Routes

Figure 18:
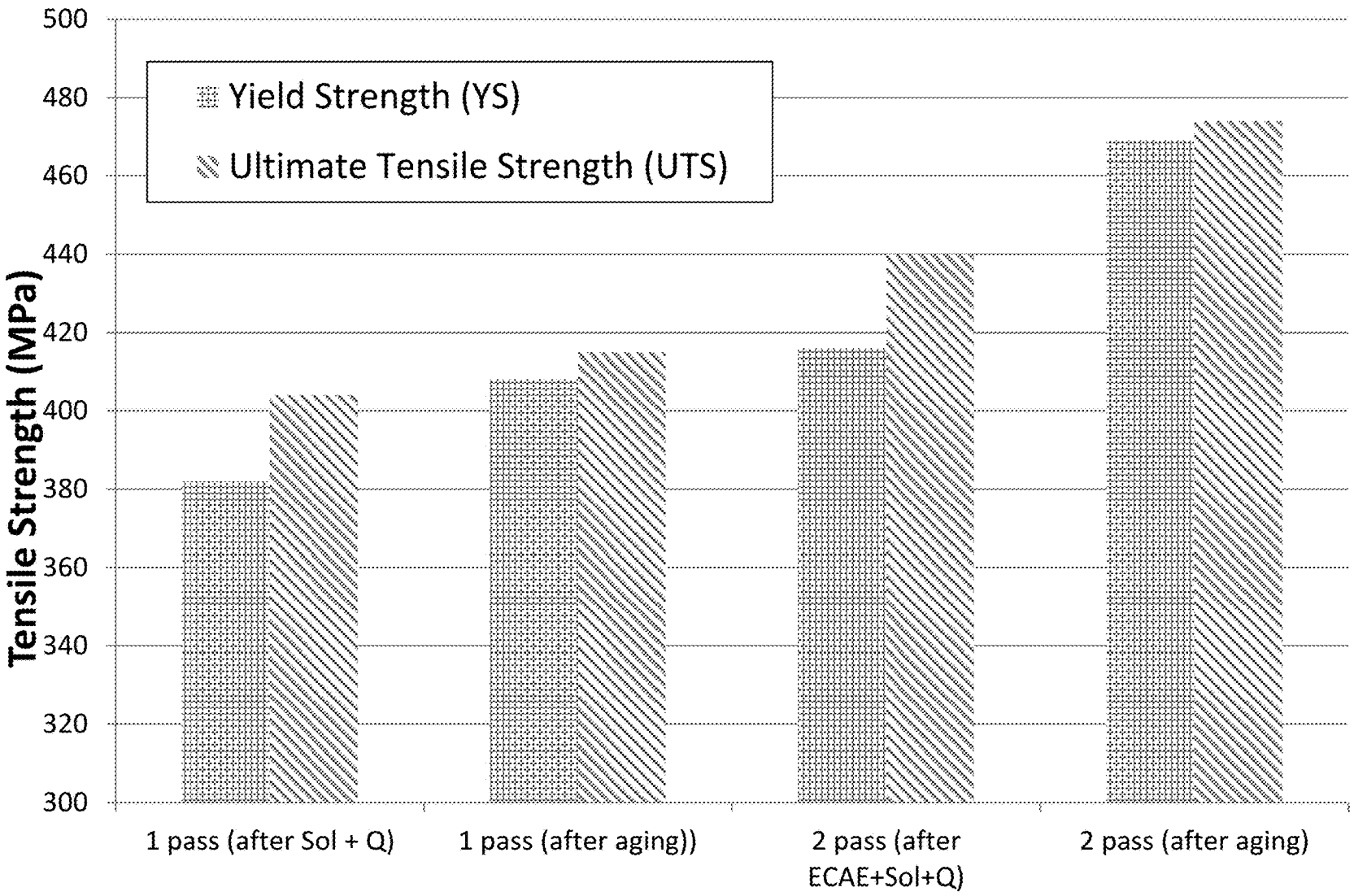
FIG. 18 is a graph comparing various processing routes to the resulting tensile strength of an aluminum alloy processed using exemplary methods disclosed herein.

Table 7 and FIG. 18 display strength data comparing the various processing routes described in Examples 3, 4 and 5. Only the samples that were subjected to ECAE at room temperature are compared, showing one and two passes.

TABLE 7

Comparison of Final Strength of Al 7020 Material After Various Processing Routes

| | | YS (MPa) | UTS (MPa) |
|---|---|---|---|
| Example 3 | 1 ECAE pass after solutionizing and quenching | 382 | 404 |
| Example 5 | 1 ECAE pass after aging | 408 | 415 |
| Example 4 | 2 ECAE passes after initial ECAE and solutionizing and quenching | 416 | 440 |
| Example 5 | 2 ECAE passes after aging | 469 | 474 |

As shown in FIG. 18 and Table 7, applying ECAE to Al 7020 alloy material samples that have both been solutionized and aged (i.e. Examples 3 and 4) does not result in as high a final strength when compared to applying ECAE to artificially aged samples (i.e. Example 5) for the same given number of passes. Namely, compare 382 MPa (Example 3) to 408 MPa (Example 5) for one ECAE pass and 416 MPa (Example 4) to 469 MPa (Example 5) for two passes. This comparison shows that standard cold working of solutionized and quenched Al 7xxx is generally not as effective as, for example, for Al 2xxx series alloys. This is generally attributed to a coarser precipitation on dislocation. This trend appears to apply also to extreme plastic deformation for Al 7xxx series alloys at least for the first two passes. This comparison indicates that a processing route that involves stabilization of precipitation by artificial aging before applying ECAE has more advantages than a route using ECAE directly after the solutionizing and quenching steps. The advantages have been shown to lead to better surface conditions, such as less cracking, for the material being extruded and allow the material to reach a higher strength for a given deformation level.

Example 7: Result of Conducting ECAE on Al 7020 Plates

Figure 19:
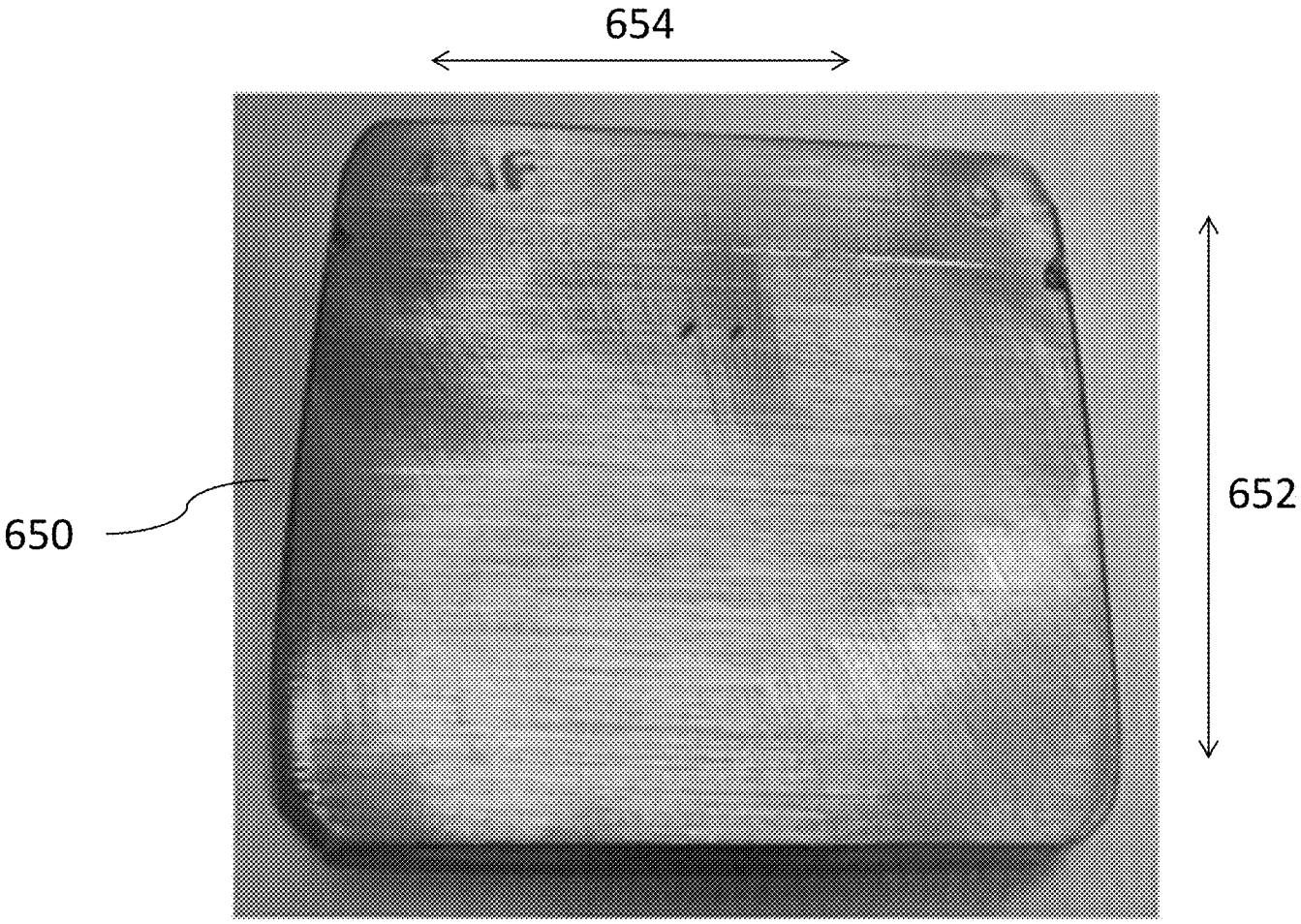
FIG. 19 is a photograph of an aluminum alloy that has been processed using exemplary methods disclosed herein.

The procedure described in Example 5 was applied to material formed into plates rather than bars, as shown in FIG. 10. FIG. 19 shows an example plate 650 having a length 652, a width 654, and a thickness less than either the length 652 or width 654. In some embodiments, the length 652 and width 654 may be substantially the same such that the plate is a square in the plane parallel to the length 652 and the width 654. Often the length 652 and width 654 are substantially larger than the thickness, for example, by a factor of three. This shape may be more advantageous for applications such as portable electronic device casings as it is a near net shape. ECAE was conducted after the same initial thermomechanical property treatment used in Example 5: solutionizing, quenching, stress relief by stretching to 2.2% and a two-step peak aging comprising a first heat treatment at 90° C. for 8 hours followed by a second heat treatment at 115° C. for 40 hours. The plate 650 in FIG. 19 is a plate of Al 7020 alloy shown after the material was subjected to ECAE.

Workability of the plate 650 was good with no severe cracking at all temperatures, including at room temperature. The results of hardness and strength testing of the plate 650 are contained in Table 8. As shown in Table 8, hardness and strength tests were taken after applying one, two, and four ECAE passes and tensile data after two and four ECAE passes. Table 8 shows that the results of applying ECAE to plates were similar to those for ECAE bars. In particular, yield strength (YS) in the material that was extruded as a plate was well above 400 MPa.

TABLE 8

Measured Values for Plates After ECAE was Applied

| | Brinell Hardness (HB) | YS (MPa) | UTS (MPa) |
|---|---|---|---|
| 1 ECAE pass | 130 | n/a | n/a |
| 2 ECAE pass | 133.5 | 452 | 456 |
| 4 ECAE pass | 140.6 | 490 | 502 |

Example 8: Effect of Rolling after ECAE

Figure 20B:
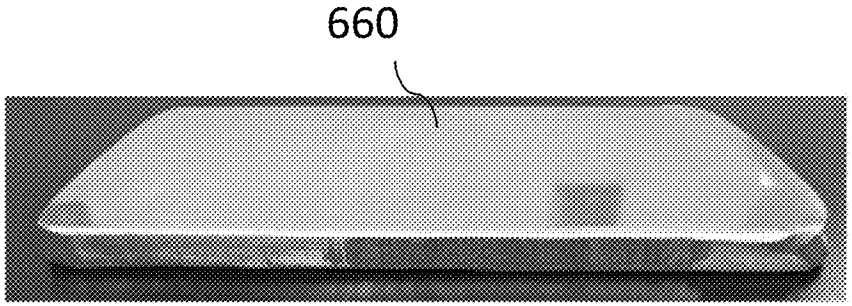
FIGS. 20A and 20B are photographs of an aluminum alloy that has been processed using exemplary methods disclosed herein.
Figure 20A:
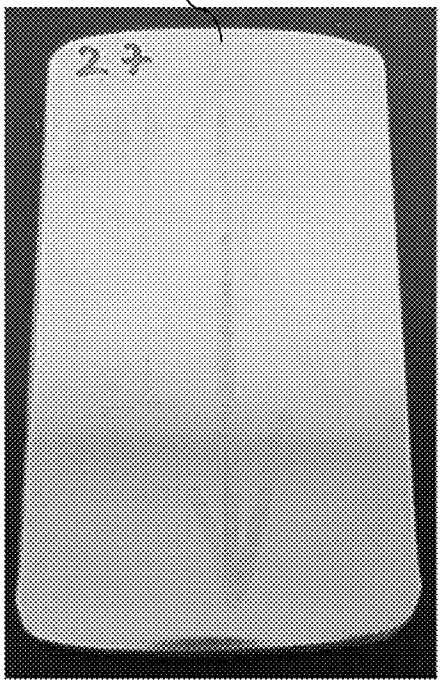

FIGS. 20A and 20B show Al 7020 alloy material that has undergone ECAE with the material formed as a plate 660. After ECAE, the plate 660 was rolled. Rolling reduced the thickness of the plate up to 50%. When multiple rolling passes are used to gradually reduce the thickness to a final thickness, the mechanical properties are often slightly better during the final rolling step as compared to the initial rolling pass after the plate 660 has undergone ECAE, as long as rolling is conducted at relatively low temperatures close to room temperature. This example demonstrates that an aluminum alloy having magnesium and zinc that has undergone ECAE has the potential to undergo further processing by conventional thermomechanical processing to form a final desirable near net shape if needed. Some example thermomechanical processing steps may encompass rolling, forging, stamping or standard extrusion, for example, as well as standard machining, finishing and cleaning steps.

Example 9: Effect of ECAE on Al 6xxx Series Alloy Material

ECAE processing was tested on other types of heat treatable alloys. An example of ECAE processing on Al 6061, a heat treatable Al 6xxx series alloy, is described first. The starting material was an as-received Al 6061 billet, in an as-cast and homogenized condition. The composition of the Al 6061 starting material containing aluminum as a primary component and magnesium and silicon as secondary components is included in Table 9.

TABLE 9

Composition of Al 6061 Starting Material (Weight Percentage)

| Si | Fe | Cu | Mn | Mg | Cr | Other | Al |
|---|---|---|---|---|---|---|---|
| 0.62 | <0.05 | <0.05 | 0.28 | 1.01 | 0.21 | <0.05 | Balance |

Initial heat treatments were performed to evaluate the effect of temperature and time on hardness, precipitation and microstructure of the Al 6061 starting material.

Heat treatment 1 (HT 1) comprised solutionizing the starting material at 530° C. for 3 hours, immediately followed by water quenching. This treatment helped dissolve the precipitates into solution. The measured hardness after HT1 was 60.5 HB.

Heat treatment 2 (HT 2) comprised solutionizing the starting material at 530° C. for 3 hours, immediately followed by water quenching and then peak aging at 175° C. for 8 hours in air. This process produced an equilibrium solid solution matrix containing many small and uniformly spaced precipitate particles of about 0.05-0.1 μm in diameter. This range of processing temperature and time is comparable to a heat treatment for producing a T6 temper in an Al 6061 alloy. The measured hardness after HT 2 was 92.6 HB. This hardness value is comparable to the ASTM standard value of 95 HB for a T6 temper. The final measured strength was a UTS of 310 MPa and a YS of 275 MPa, which are comparable to a standard Al 6061 having the T6 temper condition. These values are included in Table 10 below.

Heat treatment 3 (HT 3) comprised solutionizing the starting material at 530° C. for 3 hours, immediately followed by water quenching and then artificial over-aging at 400° C. for 8 hours in air. This process caused small soluble precipitates to grow and coalesce into large precipitates having a diameter of about 1-5 μm on average. In general, large precipitates provide minimal strengthening effects. The measured hardness of the material after HT 3 was low, around 30 HB. The heat treatment process used and the resulting hardness value is similar to material that has undergone an O temper. The final measured strength was also comparable to a standard Al 6061 alloy having an O temper. The UTS was 125 MPa and the YS was 55 MPa. These values are included in Table 10 below.

Heat treatment 4 (HT 4) comprised solutionizing the starting material at 530° C. for 3 hours, immediately followed by water quenching and natural aging at room temperature. This produced very fine precipitate particles from the supersaturated solid solution. After one month, the hardness of this material increased slowly from 60.5 to 71.5 HB and leveled off at this hardness value. After the initial one month, a duration of several days passed before an additional change in hardness was observed.

The measured results of the Al 6061 material that underwent HT 4 show that compared to Al 7020, precipitation proceeds at a slower rate in Al 6061 compared to Al 7020. As a result, during ECAE processing, the Al 6061 alloy was less sensitive to cracking, in particular after a solutionizing and quenching step. From these measurements it was shown that it is possible to perform multiple-pass ECAE on an Al 6061 alloy that has undergone one of at least two initial conditions: either directly after solutionizing and quenching or after a process that includes solutionizing, quenching and aging.

Effect of ECAE Processing on Al 6061 Alloy Material

Two examples of ECAE in combination with heat treatment were studied. In ECAE process A, which included solutionizing, quenching, peak aging and ECAE, a billet of Al 6061 material was subjected to HT 2 described above, followed by 4 ECAE passes with the die at temperature of less than 175° C. An increase in strength of the Al 6061 alloy material was attained. The final UTS of the material was 430.25 MPa and the YS was 403.3 MPa. The results are contained in Table 10.

In ECAE process B, solutionizing, quenching and ECAE was used. In this example, a billet of Al 6061 material was first subjected to HT 1 as described above. Two ECAE processes with 4 and 6 passes, respectively, were then conducted with the die maintained at a temperature below 175° C. The die and billet of Al 6061 material were heated during the ECAE process to a temperature between about 100° C. and about 140° C. That is, the die was heated during the ECAE process, and the billet of Al 6061 alloy material was heated to a temperature close to the temperature of the die (within 50° C. of the temperature of the die) for between about 5 minutes and one hour between each pass. Heating the die and billet between each ECAE pass maintained the billet at a more uniform temperature throughout the extrusion process. This intermediate heating step between each pass can also provide some annealing of the Al 6061 material in between each pass. A hardness of 133 HB was measured after the Al 6061 material underwent ECAE. This represented an increase in hardness by a factor 1.25-1.4 and 4-4.3 compared to the T6 and 0 tempers respectively. The hardness increase is believed to be due to the combined effect of the ECAE and dynamic precipitation caused during deformation and intermediate annealing applied between each ECAE pass. Measurements of the final material strength and hardness are contained in Table 10. The final UTS of 456.5 MPa and YS of 443 MPa of the Al 6061 material after undergoing ECAE process B represents an increase in UTS of 46% and a YS of 60% above that of standard Al 6061 having a T6 temper, and an increase in the UTS of 262% UTS and YS of 700% higher than that of standard Al 6061 having an O temper. Although the strength of the Al 6061 material increased, the percent elongation (around 13%) was comparable to that of a standard Al 6061 T6 (12%).

TABLE 10

Effect of ECAE on Hardness and Tensile Strength Compared to Standard Al 6061

| | YS (ksi) | UTS (ksi) | YS (MPa) | UTS (MPa) | Elongation (%) | Hardness (HB) |
|---|---|---|---|---|---|---|
| Al 6061 After ECAE process A | 58.5 | 62.4 | 403.3 | 430.25 | 13 | 127 |
| Al 6061 After ECAE process B | 64.26 | 66.21 | 443.07 | 456.52 | 13 | 133 |
| Standard Al6061-O (HT 3) | 8 | 18.1 | 55 | 125 | 25 | 30 |
| Standard Al6061-T6 (HT 2) | 39.9 | 45 | 275 | 310 | 12 | 95 |

Figure 21:
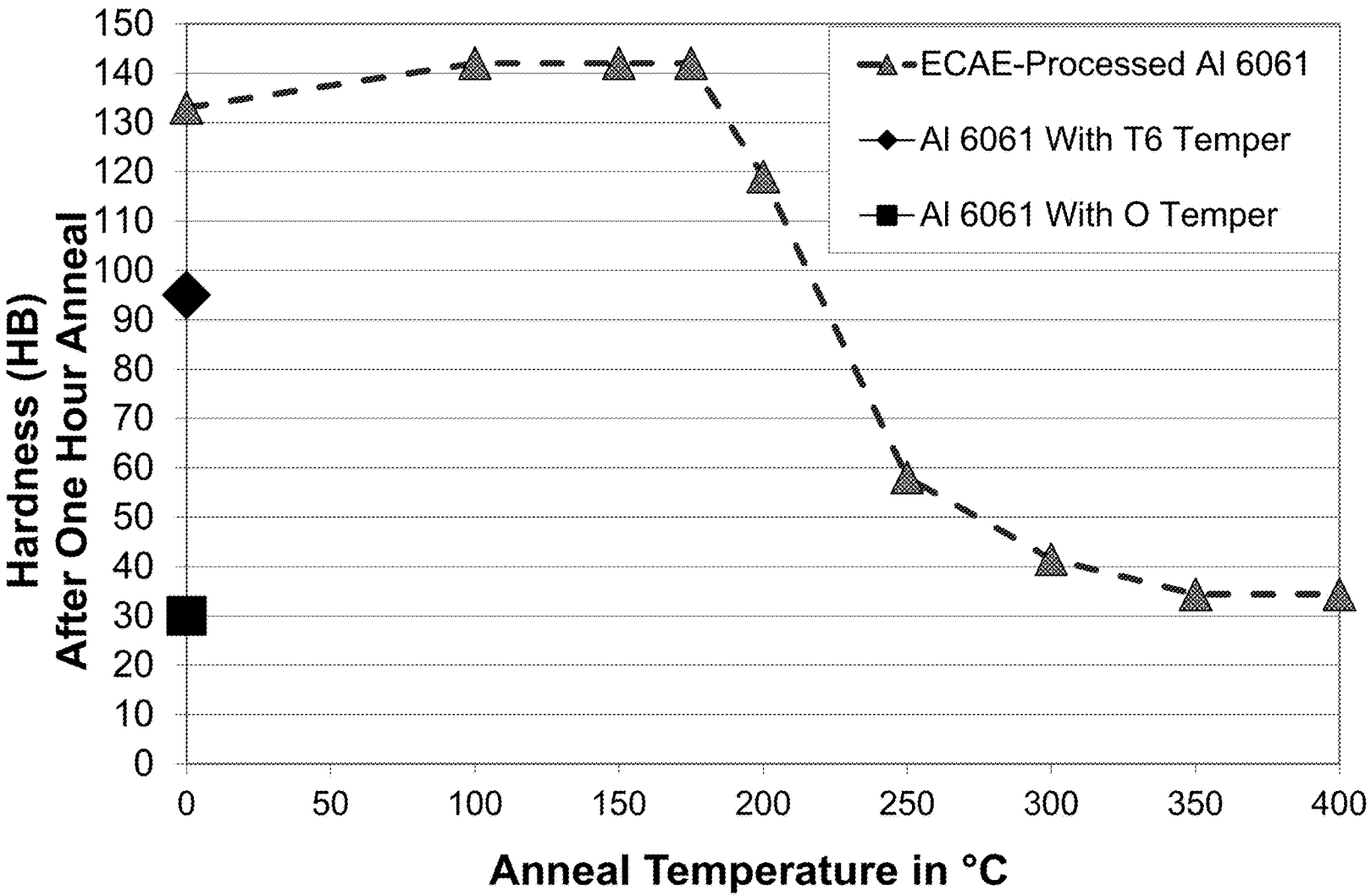
FIG. 21 is a graph comparing annealing temperature to Brinell hardness in an aluminum alloy processed using exemplary methods disclosed herein.

It was also found that including an annealing treatment with the Al 6061 alloy material held at a low temperature after ECAE can further augment the increase in strength of ECAE on an Al 6061 alloy material. FIG. 21 is a graph showing the effect of annealing temperatures between 100° C. and 400° C. for a total heat treatment time of one hour on the final Brinell hardness measured in samples that had first undergone ECAE process B described above. For heat treatment carried out at temperatures between 100° C. and 175° C. for one hour, the Brinell hardness increased to a value of about 143 HB, compared to an initial value of 133 HB measured immediately after the material underwent ECAE process B.

Example 10: Effect of ECAE on Al 2xxx Series Alloy Material

The effect of ECAE on another heat treatable Al alloy was tested. In this example, an Al 2xxx series alloy, Al 2618, was used. The composition of the Al 2618 starting material containing aluminum as a primary component and copper as a secondary component is included in Table 11. The Al2618 starting material was shaped as a billet was in the as-cast and homogenized condition.

TABLE 11

Composition of Al 2618 Starting Material (Weight Percentage)

| Si | Fe | Cu | Mn | Mg | Cr | Ni | Zn | Ti | V | B | Ga | Pb | Li | Zr | Al |
|---|---|---|---|---|---|---|---|---|---|---|---|---|---|---|---|
| 0.22 | 1.1 | 2.4 | 0 | 1.45 | 0 | 1.06 | 0.01 | 0.07 | 0 | 0.006 | 0.02 | 0 | 0 | 0 | Balance |

Initial heat treatment tests were performed to evaluate the effect of temperature and time on the precipitation dynamics of an Al 2618 alloy. The Al2618 alloy contains various types of precipitates including $CuMgAl_2$, $FeNiAl_9$ and $(Cu, Fe)Al_6$. The main soluble second phase, which is affected by solutionizing and aging treatment, is $CuMgAl_2$.

Heat treatment A (HT A) comprised solutionizing at 530° C. for 24 hours, immediately followed by water quenching. The heat treatment dissolved the soluble precipitates back into solution. The measured hardness after HT A was 72.6-76 HB Heat treatment B (HT B) comprised solutionizing at 530° C. for 24 hours, immediately followed by water quenching in boiling water and artificial peak aging at 200° C. for 20 hours in air. This produced an equilibrium solid solution matrix containing many small and uniformly spaced precipitate particles principally $CuMgAl_2$ having a diameter of about 0.05-0.1 μm. This range of temperature and time is used in Al 2618 to get the standard T6 temper. The measured hardness of the material after HT B was 114-119 HB, which was close to the ASTM standard value of 115 HB for the standard T61 temper.

Heat treatment C (HT C) comprised solutionizing at 530° C. for 24 hours, immediately followed by water quenching and annealing at 385° C. for 4 hours in air. This heat treatment allowed precipitates to grow and coalesce into large sizes. In this example, most soluble precipitates such as $CuMgAl_2$ were over one micron in diameter and had lost most of their strengthening ability. The measured hardness of the final material was around 47.5 HB. The heat treatment process used here and the resulting hardness value were similar to the standard 0 temper.

Heat treatment D (HT D) comprised solutionizing at 530° C. for 24 hours, immediately followed by water quenching then natural aging at room temperature. This heat treatment was used to gauge how fast precipitation from solid solution occurs. After 2 weeks, the hardness increased from 72.6 HB to 82 HB and, after 3-4 weeks, the hardness further increased to 100 HB. Comparing these results to Examples 1 and 9 above, for Al 2618, precipitation happens faster than in Al6061 but slower than in Al 7020.

Effect of ECAE Processing on Al 2618 Alloy Material

The effect of ECAE on the Al 2618 alloy material after heat treatment was investigated. For this test, Al 2618 material that had undergone heat treatment A was used. The temperature of the Al 2618 material during ECAE, the number of ECAE passes used, and the time and temperature of post ECAE annealing were varied to evaluate the effect of each parameter on the final strength of the Al 2618 material.

Carrying out ECAE while maintaining the Al 2618 material at a temperature above 150° C. and less than 230° C. provided a balance between material strength and good billet surface conditions. The higher processing temperature used for ECAE on the Al 2618 material was used due to the better thermal stability and a higher range of temperature and time needed for precipitation to occur, which is the result of a higher amount of Ni and Fe present in the Al 2618 alloy than in many other alloys.

The best strength results were attained when using 1 or 2 passes, compared to a greater number of passes, such as 4 passes. The measured results are included in Table 12 below. ECAE influences not only grain refinement but also the extent and dynamics of precipitation. Precipitation happens dynamically during ECAE and precipitates interact with the newly created dislocations and finer grain sizes. As shown by the measured results, this effect is the strongest when only a few passes are used, such as 1 or 2 passes. When additional passes are used, the additional passes can increase the rate of dissolution and size of precipitates thereby reducing their contribution to overall strength in the Al 2618 alloy.

The effect of post-ECAE annealing for a total duration of one hour was also measured in relation to a change in temperature between 100° C. and 400° C. For temperatures less than about 200° C., annealing further increases the strength of solutionized alloy material that undergoes ECAE for any number of passes. The measured results are shown in Table 12. The effect of pose-ECAE annealing is most pronounced for annealing temperatures between 100° C. and 150° C.

As shown in the measured values in Table 12, the most stable and highest hardness was obtained using 1 and 2 passes of ECAE. Using 2 passes, a final hardness as high as 158-160 HB can be attained even after annealing at 200° C. for one hour. Overall, the increase in hardness from an Al 2618 material having a standard T6 temper is 32.7% after 1 pass, 42.8% after 2 passes, and 23.5% after 4 passes. The increase in YS from the T6 temper was 37% for 1 pass, 53% for 2 passes, and 10% for 4 passes. One reason for this additional increase is believed to be further precipitation, distribution and growth of second phase material that remained in solid solution after ECAE, and the interaction of these particulates with the dislocation lines and newly grain boundaries produced by mechanical deformation.

TABLE 12

Hardness and Strength Comparison of ECAE-Processed Al 2618 to Standard Al 2618

| | YS (ksi) | UTS (ksi) | YS (MPa) | UTS (MPa) | Elongation (%) | Hardness (HB) |
|---|---|---|---|---|---|---|
| HT A, ECAE (1 pass) | n/a | n/a | n/a | n/a | n/a | 130 |
| HT A, ECAE (1 pass), and anneal at 150° C. for 1 hour | 73.54 | 80.06 | 507 | 552 | 14 | 158 |
| HT A, ECAE (2 passes) | 81.3 | 84.85 | 560 | 585 | 10 | 160 |
| HT A, ECAE (2 passes) and anneal at 150° C. for 1 hour | 82.1 | 86.18 | 566 | 594 | 11 | 170 |
| HT A, ECAE (4 passes) | 56.73 | 62.66 | 391 | 432 | 14 | 134 |
| HT A, ECAE (4 passes) and anneal at 150° C. for 1 hour | 59.1 | 69.2 | 407.5 | 477 | 14 | 147 |
| Standard Al 2618-O (at 25° C.) | 11 | 25 | 76 | 172 | 18 | 47.5 |
| Standard Al 2618-T6 (at 25° C.) | 53.7 | 63.1 | 370 | 435 | 10 | 119 |

(n/a: not measured)

Example 11: ECAE of Al 2xxx Series Alloy Material

Another heat treatable Al alloy from the Al 2xxx series was tested after ECAE; in this case Al 2219. The composition of the starting material containing aluminum as a primary component and copper as a secondary component is given in Table 13. The Al 2219 alloy starting material was in the as-cast and homogenized condition prior to any heat treatment. Initial heat treatment tests were performed to evaluate the effect on precipitation of soluble phases within Al 2219.

Heat treatment AA (HT AA) comprised solutionizing at 537° C. for 24 hours immediately followed by water quenching. This heat treatment dissolved all soluble precipitates back into solution. The measured hardness after HT AA was 74.1 HB.

Heat treatment BB (HT BB) comprised solutionizing at 537° C. for 24 hours immediately followed by water quenching and artificial peak aging at 190° C. for 29 hours in air. This produced an equilibrium solid solution matrix containing many small and uniformly spaced Al—Cu—Fe—Mn precipitates. The measured hardness of the material after HT BB was 115 HB, which was close to the ASTM standard value of 115 HB for this material having the T6 temper.

Heat treatment CC (HT CC) comprised solutionizing at 537° C. for 24 hours immediately followed by water quenching and annealing at 400° C. for 2 hours in air. This heat treatment allowed precipitates to grow and coalesce to large sizes of several microns and thereby, the benefits from precipitation strengthening were low. The measured hardness of the material after HT CC was around 45 HB. This heat treatment corresponds to that used in the low strength O temper for Al 2219.

Heat treatment D (HT D) comprised solutionizing at 537° C. for 24 hours immediately followed by water quenching and natural aging at room temperature. This process was used to evaluate the dynamics of precipitation from solid solution at room temperature. After 3 weeks, the hardness of the material remained stable at 74.1 HB. This indicated that Al 2219 has a slow precipitation rate, when compared to Al alloys in the Al 7xxx series.

TABLE 13

Composition of Al 2219 Starting Material

| Si | Fe | Cu | Mn | Mg | V | Ti + Zr | Others Total | Al |
|---|---|---|---|---|---|---|---|---|
| 0.07 | 0.17 | 6.23 | 0.31 | 0.011 | 0.11 | 0.21 | <0.15 | Remainder |

TABLE 14

Tensile Strength Data for Al 2219 after ECAE vs Standard Al 2219

| | YS (ksi) | UTS (ksi) | YS (MPa) | UTS (MPa) | Elongation (%) | Brinell Hardness |
|---|---|---|---|---|---|---|
| HT AA and ECAE Al 2219 (1 pass) | 60.2 | 68 | 415.1 | 469 | 18 | 139 |
| HT AA and ECAE Al 2219 (1 pass) and annealing at 150° C. for 6 hours | 62 | 71 | 427.5 | 490 | 17 | 145 |
| HTAA and ECAE Al 2219 (2 passes) | 53 | 59 | 365.4 | 407 | 19 | 130 |
| HTAA and ECAE Al 2219 (2 passes) and annealing at 150° C. for 6 hours | 58 | 64 | 399.9 | 441 | 15 | 133 |
| Standard Al 2219-O | 10.2 | 24.7 | 70.3 | 170 | 18 | 45 |
| Standard Al 2219-T62 | 42.1 | 60.2 | 290.3 | 415 | 10 | 115 |

Effect of ECAE Processing on Al 2219 Alloy Material

ECAE was conducted on Al 2219 alloy material that had undergone the HT AA heat treatment. The billet of Al 2219 material and die were heat treated prior to and in between ECAE passes to temperatures between 150° C. and 275° C., more specifically between 175° C. and 250° C. The highest strength levels in the ECAE conditions were found after 1 and 2 ECAE passes for this type of heat treatment sequence. The final results for tensile strength and Brinell hardness after 1 and 2 ECAE passes are included in Table 20. For comparison, data for the strength and hardness of an Al 2219 material with the O temper and T6 temper that has undergone standard thermomechanical processing (TMP) are also shown.

The hardness increased to 130 and 139 HB after 1 and 2 ECAE passes respectively. This is an increase by a factor of ×1.13-1.21 and ×2.9-3.1 compared to the standard T6 and 0 temper conditions respectively. Tensile testing confirmed the increase in strength as well. The largest increase was seen in the yield strength of 415 MPa for 1 pass and 365 MPa for 2 passes, which is about 26% (2 passes) to 43% (1 pass) higher than the T6 temper and 420% (2 passes) to 490% (1 pass) higher than the O temper. The ductility level of the material remained good throughout the processing steps and was similar to the T6 condition.

A low temperature heat treatment (annealing) was tested after the ECAE in order to test the effect on the final strength. The optimal temperature and time range of post-ECAE annealing was between 100° C. and 200° C. and 0.5 hours and up to 50 hours respectively. Data for the heat treatment conducted at 150° C. for 6 hours are displayed in table 20 for 1 and 2 passes. The largest strength improvement of about 8-9% in YS and UTS was observed after 2 ECAE passes. The additional strength increase resulted from the precipitation of additional second phases remaining in solid solution after ECAE.

Example 12: Effect of ECAE on Non Heat-Treatable Alloys (Al 5xxx Series Alloys)

The effect of ECAE on Al 5083, an Al alloy in the Al 5xxx series, was measured. Table 15 displays the composition of the Al 5083 alloy material containing aluminum as a primary component and magnesium and manganese as secondary components used in this example. Like most wrought Al alloys in the 5xxx series, Al 5083 is mostly based on the Al—Mg binary system and does not show appreciable precipitation hardening characteristics, which is expected for Al alloys having magnesium at concentrations below 7 wt. %. For this reason, Al 5083 is referred to as a non-heat-treatable Al alloy, in which heat treatments such as solutionizing, quenching and age hardening generally do not create fine soluble precipitates. Common second phases in Al 5083 are, for example, $Mg_2Al$ or $MnAl_6$. These second phases are non-soluble and are created during the initial casting and cooling steps, and stay mostly stable in size and number during subsequent heat treatments.

In non-heat-treatable Al alloys, because precipitation hardening is generally not very effective, one way to increase strength is by dislocation hardening. In dislocation hardening, a high amount of dislocations are introduced into the material grains during hot or cold working using TMP techniques such as rolling, forging or drawing. These TMP techniques introduce strain into the processed material, for example, by reducing the thickness of a sample while other dimensions increase. The amount and density of dislocations in the resulting material is directly related to the amount of strain introduced into the material and therefore also related to the amount of mechanical deformation of the material. In practice, often the achievable mechanical deformation of the material may be limited, such as for fairly thick plates, for example greater than 0.5-1 inch thick. In such an example, the final strength of the material depends on how fine the initial grain size is in the material before applying TMP techniques, which is often set by the casting process.

ECAE as described above offers two strengthening mechanisms: grain size (Hall Petch) hardening and dislocation hardening. This means that ECAE offers an additional strengthening mechanism over standard TMP methods. That is, ECAE provides a strengthening mechanism in addition to Hall Petch hardening. ECAE also does not change the billet thickness or shape dimensions, so large billets can be strengthened throughout the thickness of the billet while also introducing a very high level of strain.

In this example, an as-cast and homogenized Al 5083 material having the composition listed in Table 15 with aluminum present as a primary component was processed. In order to limit surface cracking of the Al 5083 billet during ECAE, the ECAE die and the billet of Al 5083 material that was being extruded were heated during the extrusion. A suitable temperature range for maintaining the Al 5083 material at during ECAE was found to be between 150° C. and 275° C., from about 175° C. to about 250° C. Multiple passes of ECAE were tested, and the Al 5083 material measured after the total number of passes was between 4 and 6. Table 14 shows the resulting tensile strength data for Al 5083 having undergone 4 passes versus a standard Al 5083 with either the O temper (fully annealed) or the H116 temper (cold rolled). Increases in strength and hardness were measured after the material underwent ECAE, with a sharp increase in both yield strength (399 MPa which was a 77% increase over the H116 temper) and ultimate tensile strength (421 MPa which was a 37.8% increase over the H116 temper).

It was further shown that additional strengthening could be introduced by using TMP techniques such as rolling or forging of the Al 5083 material after the ECAE process. Table 14 shows an example that included additional cold rolling of the Al 5083 material to a 35% height reduction that was performed after ECAE. The final YS and UTS were 418 MPa and 441 MPa respectively. In this example, the microstructure of the Al 5083 alloy after ECAE but before cold rolling had a relatively fine submicron grain size and additional dislocations were imparted during the rolling step to further contribute to the final strength. Factors that can be controlled to reduce forming defects in the material during cold rolling include percent height reduction of the material per pass, the diameter of the roller used, trimming of sharp edges and corners, and the roller temperature.

TABLE 15

Composition of Al 5083 Starting Material (Weight Percent)

| Si | Fe | Cu | Mn | Mg | Cr | Zn | Ti | Others Total | Al |
|---|---|---|---|---|---|---|---|---|---|
| 0.28 | 0.224 | 0.066 | 0.639 | 4.551 | 0.105 | 0.104 | 0.0234 | 0.0621 | Balance |

TABLE 16

Tensile Strength Data for Al 5083 After ECAE vs Standard Al 5083

| | YS (ksi) | UTS (ksi) | YS (MPa) | UTS (MPa) |
|---|---|---|---|---|
| Standard Al 5083-O | 21 | 42.1 | 145 | 290 |
| Standard Al 5083-H116 | 32.66 | 44.24 | 225 | 305 |
| ECAE | 57.84 | 60.99 | 399 | 421 |
| ECAE and 35% Height Reduction with Cold Rolling | 60.58 | 64 | 418 | 441 |

Example 13: Effect of ECAE on Non Heat-Treatable Alloys (Al 5xxx and Al 3xxx Series Alloys)

In this example, 2 more non heat treatable Al alloys, namely Al 5456 from the Al 5xxx series and Al 3004 from the Al 3xxx series, were processed using ECAE according to a similar process used in Example 12 above, with some alterations. The composition of the starting Al alloys containing aluminum as a primary component and magnesium and manganese as secondary components used in this example is given in Tables 17 and 18. In table 17, "Others Each" is the maximum weight percentage of any single element other than those listed, and "Others Total" is the maximum combined weight percentage of all elements other than those listed.

The total number of ECAE passes used was between 4 and 6 passes. A suitable process temperature was found to be between 100° C. and 275° C., from about 150° C. to about 225° C., which provided good surface conditions for the billet.

The final measured tensile properties are given in Tables 19 and 20. Measurements for Al 3004 and Al 5456 having commercial tempers are also given for comparison, either for the fully annealed condition (O temper) or for various degrees of strain working, for example, the H116 temper for Al 5456 and H38 temper for Al 3004. As shown in the measured values contained in Tables 19 and 20, ECAE improved the YS and UTS values, about 1.5-8 times for YS and about 1.3-1.4 times for UTS, above the standard strain worked tempers H116 or H38. The strength increases were greater when compared to the O temper.

As described in Example 12, it was shown to be advantageous to subject the material to cold rolling after conducting ECAE, in order to increase the final strength of the Al alloy further. Cold rolling with a 40% reduction in billet height was used. The resulting mechanical properties are shown at the bottom row of Table 19.

It should be noted that a YS above 350 MPa is relatively high for Al alloys from the Al 3xxx and Al 5xxx series which are typically weaker than those from the Al 2xxx and Al 7xxx series. The resulting strength increase in the Al 3xxx and Al 5xxx series alloys that is imparted by the process in this example means that a user can choose from a wider range of alloys when deciding on an Al alloy having a strength above a particular value. In other words, a wider range of Al alloys having a desired strength can be formed from alloys in a series other than just the Al 2xxx and Al 7xxx series. An alloy that may be more suitable because of a particular feature, such as its cosmetic appeal, but that previously was not suitable because of for example a lower strength, may be processed using the techniques described above, resulting in a material that has more of the desired properties than before.

TABLE 17

| Composition of Starting Material of Al 5456 (Weight Percent) | | | | | | | | | | |
|---|---|---|---|---|---|---|---|---|---|---|
| Si | Fe | Cu | Mn | Mg | Cr | Zn | Ti | Others Each | Others Total | Al |
| 0.117 | 0.158 | 0.009 | 0.663 | 5.24 | 0.084 | 0.013 | 0.021 | 0.015 | <0.045 | Balance |

TABLE 18

| Composition of Starting Material of Al 3004 (Weight Percent) | | | | | | | | |
|---|---|---|---|---|---|---|---|---|
| Si | Fe | Cu | Mn | Mg | Cr | Zn | Others Total | Al |
| 0.19 | 0.41 | 0.16 | 1.31 | 1.06 | 0.27 | 0.12 | <0.15 | Balance |

TABLE 19

| Tensile Strength Data for Al 5456 After ECAE vs Standard Al 5456 | | | | |
|---|---|---|---|---|
| | YS (ksi) | UTS (ksi) | YS (MPa) | UTS (MPa) |
| Standard Al 5456-O | 23.2 | 45 | 160 | 310 |
| Standard Al 5456-H116 | 37.1 | 50.8 | 255 | 350 |
| Al 5456 After ECAE | 62.9 | 65.8 | 434 | 454 |
| Al 5456 After ECAE and cold rolling | 65.4 | 67.6 | 451 | 466 |

TABLE 20

| Tensile Strength Data for Al 3004 After ECAE vs Standard Al 3004 | | | | |
|---|---|---|---|---|
| | YS (ksi) | UTS (ksi) | YS (MPa) | UTS (MPa) |
| Standard Al 3004-O | 10.2 | 26.1 | 70 | 180 |
| Standard Al 3004-H38 | 36.3 | 41.3 | 250 | 285 |
| Al 3004 After ECAE | 55.1 | 57.2 | 380 | 394 |

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

What is claimed is:

1. A method of forming a high strength aluminum alloy, the method comprising:

heating an aluminum material containing aluminum as a primary component and at least one of magnesium, manganese, silicon, copper, and zinc as a secondary component at a concentration of at least 0.1% by weight to a temperature from about 400° C. to about 550° C. to form a heated aluminum material;

quenching the heated aluminum material to room temperature to form a cooled aluminum material;

aging the cooled aluminum material by heating to form aged aluminum material; and subjecting the aged aluminum material to an equal channel angular extrusion (ECAE) process while maintaining the aged aluminum material at a temperature from about 0° C. to about 200° C. to form a high strength aluminum alloy, wherein the high strength aluminum alloy has an average grain size from about 0.2 μm to about 0.8 μm in diameter and a yield strength from about 300 MPa to about 650 MPa;

wherein aging the cooled aluminum material by heating includes a first heating step followed by a second heating step, the first heating step at a temperature from about 80° C. to about 100° C. for from about 1 hour to about 50 hours and the second heating step at a temperature from about 100° C. to about 170° C. for from about 20 hours to about 100 hours.

2. The method of claim 1, wherein aging the cooled aluminum material by heating includes a first heating step followed by a second heating step, the first heating step at a temperature from about 85° C. to about 95° C. for from about 8 hours to about 40 hours and the second heating step a temperature from about 100° C. to about 160° C. for from about 35 hours to about 60 hours.

3. The method of claim 2, wherein the aged aluminum material is subjected to the ECAE process while maintaining the aged aluminum material at a temperature from about 20° C. to about 125° C.

4. The method of claim 2, wherein the aged aluminum material is subjected to the ECAE process while maintaining the aged aluminum material at a temperature from about 20° C. to about 35° C.

5. The method of claim 1, wherein aging the cooled aluminum material by heating includes a first heating step followed by a second heating step, the first heating step at a temperature from about 88° C. to about 92° C. for from about 8 hours to about 20 hours and the second heating step a temperature from about 110° C. to about 160° C. for from about 40 hours to about 45 hours.

6. The method of claim 5, wherein the aged aluminum material is subjected to the ECAE process while maintaining the aged aluminum material at a temperature from about 20° C. to about 125° C.

7. The method of claim 5, wherein the aged aluminum material is subjected to the ECAE process while maintaining the aged aluminum material at a temperature from about 20° C. to about 35° C.

8. The method of claim 1, wherein the aged aluminum material is subjected to the ECAE process while maintaining the aged aluminum material at a temperature from about 20° C. to about 125° C.

9. The method of claim 1, wherein the aged aluminum material is subjected to the ECAE process while maintaining the aged aluminum material at a temperature from about 20° C. to about 35° C.

* * * * *